US009005860B2

(12) United States Patent
Miyata et al.

(10) Patent No.: US 9,005,860 B2
(45) Date of Patent: Apr. 14, 2015

(54) ELECTROSTATIC-IMAGE DEVELOPING TONER, ELECTROSTATIC IMAGE DEVELOPER, TONER CARTRIDGE, PROCESS CARTRIDGE, IMAGE-FORMING APPARATUS, AND METHOD FOR FORMING IMAGE

(71) Applicant: Fuji Xerox Co., Ltd., Tokyo (JP)

(72) Inventors: Emi Miyata, Minamiashigara (JP); Hirotaka Matsuoka, Minamiashigara (JP); Susumu Yoshino, Minamiashigara (JP); Yuki Sasaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 15 days.

(21) Appl. No.: 13/761,905

(22) Filed: Feb. 7, 2013

(65) Prior Publication Data

US 2014/0080053 A1 Mar. 20, 2014

(30) Foreign Application Priority Data

Sep. 18, 2012 (JP) ..... 2012-204623

(51) Int. Cl.
*G03G 9/00* (2006.01)
*G03G 9/08* (2006.01)
(Continued)

(52) U.S. Cl.
CPC ..... *G03G 9/08* (2013.01); *G03G 15/0806* (2013.01); *G03G 2215/0132* (2013.01); *G03G 9/0804* (2013.01); *G03G 9/08755* (2013.01); *G03G 9/08764* (2013.01); *G03G 9/08775* (2013.01)

(58) Field of Classification Search
CPC .. G03G 9/08; G03G 9/08755; G03G 9/08764
USPC ..... 430/109.1, 109.4, 109.5, 137.17
See application file for complete search history.

(56) References Cited

U.S. PATENT DOCUMENTS 8,568,950 B2 * 10/2013 Shiozaki et al. ..... 430/109.4
8,652,731 B2 * 2/2014 Sasaki et al. ..... 430/109.4
(Continued)

FOREIGN PATENT DOCUMENTS

JP A-8-20636 1/1996
JP A-10-239903 9/1998
(Continued)

*Primary Examiner* — Thorl Chea
(74) *Attorney, Agent, or Firm* — Oliff PLC

(57) ABSTRACT

An electrostatic-image developing toner contains a polyester resin prepared by addition reaction of a polycondensate of a carboxylic acid component and an alcohol component with an isocyanate-containing compound. The polycondensate has an active hydrogen group. The alcohol component includes a rosin diol represented by general formula (1):

(1)

(wherein $R^1$ and $R^2$ are each independently hydrogen or methyl; $L^1$, $L^2$, and $L^3$ are each independently a divalent linking group selected from the group consisting of carbonyl, carboxyl, ether, sulfonyl, optionally substituted linear alkylenes, optionally substituted cyclic alkylenes, optionally substituted arylenes, and combinations thereof; $L^1$ and $L^2$ or $L^1$ and $L^3$ are optionally taken together to form a ring; and $A^1$ and $A^2$ are rosin ester groups).

13 Claims, 2 Drawing Sheets

(51) Int. Cl.
*G03G 15/08* (2006.01)
*G03G 9/087* (2006.01)

(56) References Cited

U.S. PATENT DOCUMENTS 8,709,691 B2 * 4/2014 Matsuoka et al. ..... 430/109.4
8,709,692 B2 * 4/2014 Miyata et al. ..... 430/109.4
8,709,693 B2 * 4/2014 Yamasaki et al. ..... 430/109.4
8,709,694 B2 * 4/2014 Matsuoka et al. ..... 430/109.5
2010/0316944 A1 12/2010 Nakajima et al.

FOREIGN PATENT DOCUMENTS

JP A-11-133668 5/1999
JP A-2006-3680 1/2006
JP A-2007-248704 9/2007
JP A-2008-281884 11/2008
JP A-2010-286610 12/2010

* cited by examiner

ELECTROSTATIC-IMAGE DEVELOPING TONER, ELECTROSTATIC IMAGE DEVELOPER, TONER CARTRIDGE, PROCESS CARTRIDGE, IMAGE-FORMING APPARATUS, AND METHOD FOR FORMING IMAGE

CROSS-REFERENCE TO RELATED APPLICATIONS

This application is based on and claims priority under 35 USC 119 from Japanese Patent Application No. 2012-204623 filed Sep. 18, 2012.

BACKGROUND

1. Technical Field

The present invention relates to electrostatic-image developing toners, electrostatic image developers, toner cartridges, process cartridges, image-forming apparatuses, and methods for forming images.

2. Summary

According to an aspect of the invention, there is provided an electrostatic-image developing toner containing a polyester resin prepared by addition reaction of a polycondensate of a carboxylic acid component and an alcohol component with an isocyanate-containing compound. The polycondensate has an active hydrogen group. The alcohol component includes a rosin diol represented by general formula (1):

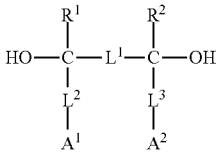

(1)

wherein $R^1$ and $R^2$ are each independently hydrogen or methyl; $L^1$, $L^2$, and $L^3$ are each independently a divalent linking group selected from the group consisting of carbonyl, carboxyl, ether, sulfonyl, optionally substituted linear alkylenes, optionally substituted cyclic alkylenes, optionally substituted arylenes, and combinations thereof; $L^1$ and $L^2$ or $L^1$ and $L^3$ are optionally taken together to form a ring; and $A^1$ and $A^2$ are rosin ester groups.

BRIEF DESCRIPTION OF THE DRAWINGS

Exemplary embodiments of the present invention will be described in detail based on the following figures, wherein.

DETAILED DESCRIPTION

Figure 1:
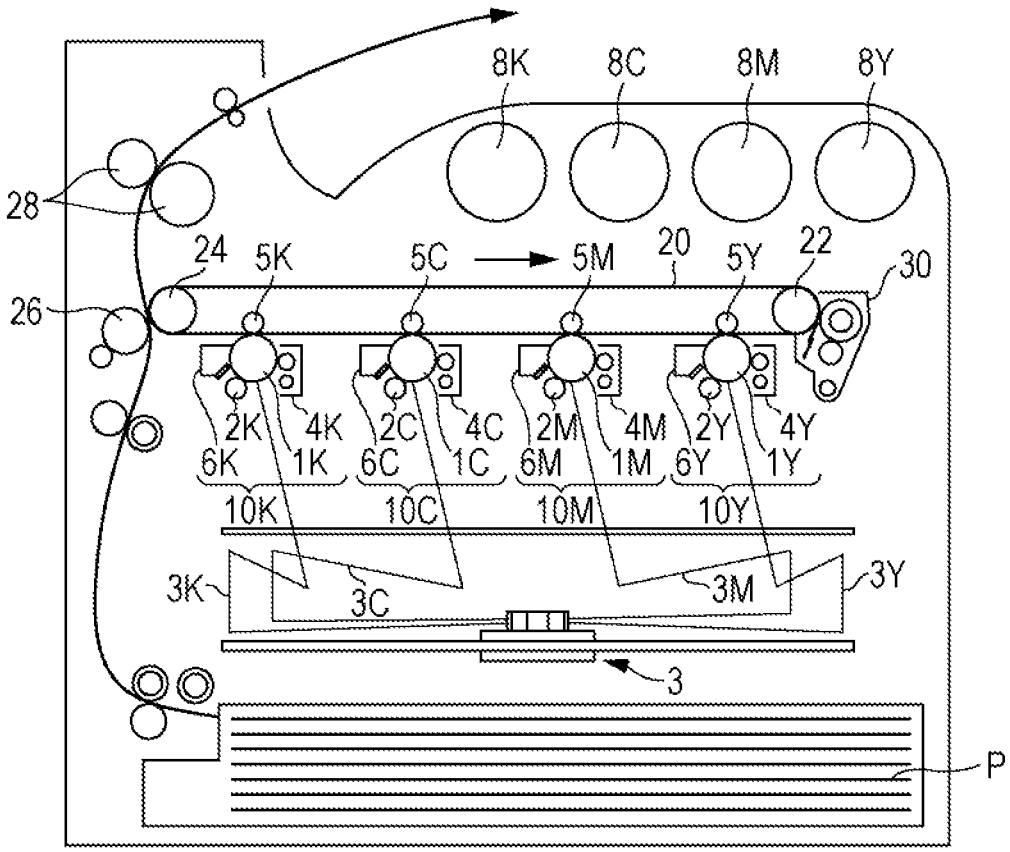
FIG. 1 is a schematic view of an image-forming apparatus according to an exemplary embodiment.

Exemplary embodiments of the present invention will now be described in detail.

Electrostatic-Image Developing Toner

An electrostatic-image developing toner (hereinafter referred to as "toner") according to an exemplary embodiment contains a polyester resin (hereinafter referred to as "particular polyester resin") prepared by addition reaction of a polycondensate (hereinafter referred to as "particular rosin-based polycondensate"), having an active hydrogen group, of a carboxylic acid component and an alcohol component including a rosin diol represented by general formula (1) with an isocyanate-containing compound.

A polycondensate (polyester resin) of a carboxylic acid component and an alcohol component including a rosin diol may be synthesized with high reactivity because a rosin diol, which has a hydrophobic rosin backbone, is used as a polycondensation component. The polycondensate may improve toner properties such as blocking resistance and chargeability.

However, because the rosin backbone is hydrophobic, a toner containing a polycondensate synthesized using an alcohol component including a rosin diol has a higher hydrophobicity. Such a toner tends to have a lower affinity with transfer media, i.e., hydrophilic recording media (particularly, hydrophilic paper).

As a result, a fixed image formed of a toner containing a polycondensate synthesized using an alcohol component including a rosin diol has a lower affinity with recording media and therefore a lower strength against tape peeling.

The toner according to this exemplary embodiment, containing the polyester resin described above, may allow formation of a fixed image with improved peel strength.

Although the mechanism is not fully understood, it is believed to be as follows.

The particular polyester resin contained in the toner according to this exemplary embodiment has urethane bonds formed by addition reaction of the active hydrogen group of the particular rosin-based polycondensate with the isocyanate group of the isocyanate-containing compound.

Because urethane bonds are more hydrophilic than ester bonds, the particular polyester resin may be more hydrophilic than, for example, a polycondensate having no urethane bond (e.g., a particular rosin-based polycondensate).

As a result, the toner containing the particular polyester resin may have a higher hydrophilicity and therefore a higher affinity with recording media (particularly, hydrophilic paper). Accordingly, a fixed image formed of the toner containing the particular polyester resin may have a higher affinity with recording media.

Thus, the toner according to this exemplary embodiment may allow formation of a fixed image with improved peel strength.

The resin contained in the toner according to this exemplary embodiment, which has a rosin backbone introduced as a side chain of the particular polyester resin or particular rosin-based polycondensate, may be stiffer than a resin having rosin introduced in the main chain thereof. Thus, the toner according to this exemplary embodiment may have a higher blocking resistance and therefore a higher thermal storage stability than a toner containing a resin having rosin introduced in the main chain thereof.

The toner according to this exemplary embodiment will now be described in detail.

Specifically, the toner according to this exemplary embodiment contains toner particles containing the particular polyester resin and optionally a surface additive.

Toner Particles

The toner particles will now be described.

The toner particles contain a binder resin and optionally a colorant, a release agent, and other additives.

Binder Resin

Particular Polyester Resin

The binder resin contains at least the particular polyester resin.

The particular polyester resin, as described above, is prepared by addition reaction of a particular rosin-based polycondensate with an isocyanate-containing compound. Specifically, for example, the particular polyester resin is prepared by addition reaction of the active hydrogen group of the particular rosin-based polycondensate with the isocyanate group of the isocyanate-containing compound.

Examples of particular polyester resins include those having the isocyanate-containing compound added to one or both ends of the particular rosin-based polycondensate and those having the isocyanate-containing compound added to side chains of the particular rosin-based polycondensate.

The particular polyester resin may have multiple molecules of the isocyanate-containing compound added to one molecule of the particular rosin-based polycondensate.

The particular polyester resin may be crosslinked by the isocyanate-containing compound.

The particular polyester resin has at least ester bonds and urethane bonds.

The ratio of urethane bonds to ester bonds is preferably 3:1 to 1:10 or about 3:1 to 1:10, more preferably 1:1 to 1:5 or about 1:1 to 1:5, for improved peel strength of fixed images.

As described above, the particular polyester resin is prepared using the particular rosin-based polycondensate for addition reaction.

The particular rosin-based polycondensate is a polycondensate of a carboxylic acid component and an alcohol component. The polycondensate has an active hydrogen group. The alcohol component includes a rosin diol represented by general formula (1) (hereinafter referred to as "particular rosin diol").

Examples of active hydrogen groups include hydrogen groups in functional groups such as alcoholic hydroxyl (—OH), carboxyl (—COOH), thiol (—SH), and amino (—$NH_2$ or —NH—), of which a hydrogen group in alcoholic hydroxyl (—OH) is preferred.

The active hydrogen group may be contained in any of the monomers of the particular rosin-based polycondensate, i.e., the carboxylic acid component and the alcohol component. The particular rosin-based polycondensate may have the active hydrogen group at one or both ends thereof or in side chains thereof.

To form more urethane bonds in the particular rosin-based polycondensate, the particular rosin-based polycondensate may have the active hydrogen group at both ends thereof, and the active hydrogen group may be derived from the hydroxyl groups of the rosin diol.

The monomers may have different groups selected from the above groups having an active hydrogen group.

The particular rosin-based polycondensate will now be described.

The alcohol component, which is one of the polycondensation components, will be described first.

The alcohol component includes a rosin diol represented by general formula (1):

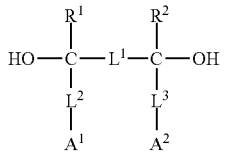

(1)

where $R^1$ and $R^2$ are each independently hydrogen or methyl; $L^1$, $L^2$, and $L^3$ are each independently a divalent linking group selected from the group consisting of carbonyl, carboxyl, ether, sulfonyl, optionally substituted linear alkylenes, optionally substituted cyclic alkylenes, optionally substituted arylenes, and combinations thereof; $L^1$ and $L^2$ or $L^1$ and $L^3$ are optionally taken together to form a ring; and $A^1$ and $A^2$ are rosin ester groups.

Examples of linear alkylenes for $L^1$, $L^2$, and $L^3$ include alkylenes having 1 to 10 carbon atoms.

Examples of cyclic alkylenes for $L^1$, $L^2$, and $L^3$ include cyclic alkylenes having 3 to 7 carbon atoms.

Examples of arylenes for $L^1$, $L^2$, and $L^3$ include phenylene, naphthylene, and anthracenylene.

Examples of substituents on linear alkylenes, cyclic alkylenes, and arylenes include alkyls having 1 to 8 carbon atoms and aryls, of which linear, branched, and cyclic alkyls are preferred. Specific examples include methyl, ethyl, propyl, butyl, pentyl, hexyl, heptyl, octyl, isopropyl, isobutyl, s-butyl, t-butyl, isopentyl, neopentyl, 1-methylbutyl, isohexyl, 2-ethylhexyl, 2-methylhexyl, cyclopentyl, cyclohexyl, and phenyl.

The rosin diol represented by general formula (1) has two rosin ester groups per molecule.

As used herein, the term "rosin ester group" refers to the residue of the carboxyl group contained in the rosin after a hydrogen atom is removed therefrom.

The rosin diol represented by general formula (1) may be synthesized in a known manner. For example, the rosin diol is synthesized from a rosin and a difunctional epoxy compound.

An example of a synthesis scheme of a rosin diol is illustrated below:

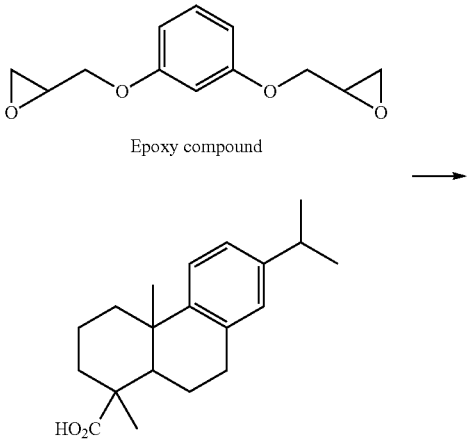

-continued

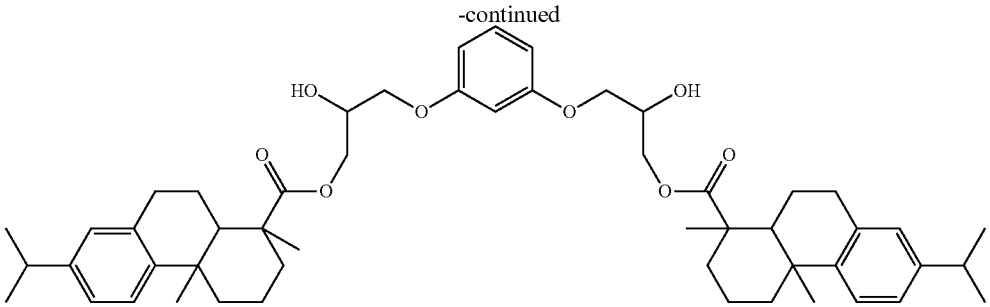

Rosin diol

The difunctional epoxy compound contains two epoxy groups per molecule. Examples of difunctional epoxy compounds include diglycidyl ethers of aromatic diols, diglycidyl ethers of aromatic dicarboxylic acids, diglycidyl ether of aliphatic diols, diglycidyl ethers of alicyclic diols, and alicyclic epoxides.

Typical examples of aromatic diol components for diglycidyl ethers of aromatic diols include bisphenol A derivatives such as bisphenol A and polyalkylene oxide adducts of bisphenol A; bisphenol F derivatives such as bisphenol F and polyalkylene oxide adducts of bisphenol F; bisphenol S derivatives such as bisphenol S and polyalkylene oxide adducts of bisphenol S; resorcinol; t-butyl catechol; and biphenol.

Typical examples of aromatic dicarboxylic acid components for diglycidyl ethers of aromatic dicarboxylic acids include terephthalic acid, isophthalic acid, and phthalic acid.

Typical examples of aliphatic diol components for diglycidyl ethers of aliphatic diols include ethylene glycol, 1,2-propanediol, 1,3-propanediol, 1,4-butanediol, 1,5-pentanediol, 1,6-hexanediol, neopentyl glycol, 1,9-nonanediol, diethylene glycol, triethylene glycol, polyethylene glycol, polypropylene glycol, and polytetramethylene glycol.

Typical examples of alicyclic diol components for diglycidyl ethers of alicyclic diols include hydrogenated bisphenol A derivatives such as hydrogenated bisphenol A and polyalkylene oxide adducts of hydrogenated bisphenol A, and cyclohexanedimethanol.

Typical examples of alicyclic epoxides include limonene dioxide.

The above epoxy-containing compounds are prepared by, for example, reaction of a diol and an epihalohydrin, which may be polymerized by polycondensation depending on the ratio thereof.

The reaction between the rosin and the difunctional epoxy compound involves a ring-opening reaction of the epoxy groups of the difunctional epoxy compound with the carboxyl group of the rosin. The reaction temperature may be equal to or higher than the melting temperatures of the two components, or may be a temperature at which they are homogeneously mixed together. Specifically, the reaction temperature is typically 60° C. to 200° C. A catalyst that promotes the ring-opening reaction of the epoxy groups may be added.

Examples of catalysts include amines such as ethylenediamine, trimethylamine, and 2-methylimidazole; quaternary ammonium salts such as triethylammonium bromide, triethylammonium chloride, and butyltrimethylammonium chloride; and triphenylphosphine.

The reaction may be performed in various manners. Typically, in a batch process, the rosin and the difunctional epoxy compound are charged in a flask having a heating function and equipped with instruments such as a condenser, a stirrer, an inert gas inlet, and a thermometer, and are melted by heating. The reaction product is sampled to keep track of the progress of the reaction. The progress of the reaction may be determined based on a decrease in acid value. The reaction is terminated at or near the stoichiometric endpoint of the reaction.

The rosin and the difunctional epoxy compound may be reacted in any ratio. For example, the molar ratio of the rosin to the difunctional epoxy compound may be 1.5:1 to 2.5:1.

As used herein, the term "rosin" is a generic term for resin acids obtained from trees. Specifically, it refers to a naturally occurring material containing abietic acid, which is a type of tricyclic diterpene, and derivatives thereof as major components. Examples of specific components include abietic acid, palustric acid, neoabietic acid, pimaric acid, dehydroabietic acid, isopimaric acid, and sandaracopimaric acid. The rosin used in this exemplary embodiment is a mixture of such resin acids.

According to the method for extraction, rosins are broadly classified into tall oil rosin, which is obtained from pulp, gum rosin, which is obtained from crude turpentine, and wood rosin, which is obtained from pine stumps. For example, the rosin used in this exemplary embodiment may be gum rosin or tall oil rosin because they are easily available.

The rosin may be purified. Purified rosin is obtained by removing a polymeric component, which is presumably derived from peroxides of resin acids, and an unsaponifiable component from crude rosin. The rosin may be purified in any manner. For example, various known purification processes are available, including distillation, recrystallization, and extraction. For industrial production, the rosin may be purified by distillation. Distillation is typically performed at 200° C. to 300° C. and 6.67 kPa or less, depending on the distillation time. Recrystallization is performed by, for example, dissolving crude rosin in a good solvent, removing the solvent to concentrate the solution, and adding a poor solvent to the solution. Examples of good solvents include aromatic hydrocarbons such as benzene, toluene, and xylene, chlorinated hydrocarbons such as chloroform, alcohols such as lower alcohols, ketones such as acetone, and acetate esters such as ethyl acetate. Examples of poor solvents include hydrocarbons such as n-hexane, n-heptane, cyclohexane, and isooctane. Extraction is performed by, for example, dissolving crude rosin in alkaline water to prepare an aqueous alkaline solution, extracting an insoluble unsaponifiable component therefrom using an organic solvent, and neutralizing the water layer to obtain purified rosin.

The rosin may be disproportionated rosin. Disproportionated rosin is prepared by heating a rosin containing abietic acid as a major component at high temperature in the presence of a disproportionation catalyst to eliminate conjugated double bonds, which are unstable, from the molecule. Disproportionated rosin contains dehydroabietic acid and dihydroabietic acid as major components.

Various known disproportionation catalysts are available, including supported catalysts such as palladium carbon, rhodium carbon, and platinum carbon; powdered metals such as nickel and platinum; and iodine and iodides such as iron iodide.

The rosin may also be hydrogenated to eliminate conjugated double bonds, which are unstable, from the molecule. The rosin may be hydrogenated under known hydrogenation reaction conditions. For example, the rosin may be hydrogenated by heating in the presence of a hydrogenation catalyst under hydrogen pressure. Various known hydrogenation catalysts are available, including supported catalysts such as palladium carbon, rhodium carbon, and platinum carbon; powdered metals such as nickel and platinum; and iodine and iodides such as iron iodide.

The rosin may be purified as above before or after disproportionation or hydrogenation.

Examples of particular rosin diols suitable for this exemplary embodiment include, but not limited to, the following exemplary compounds:

(1)

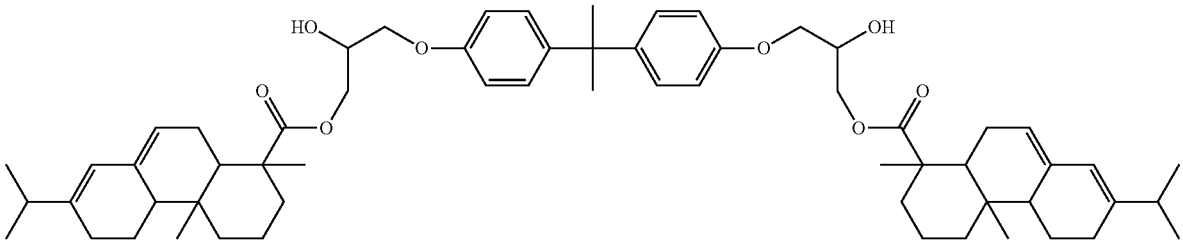

(2)

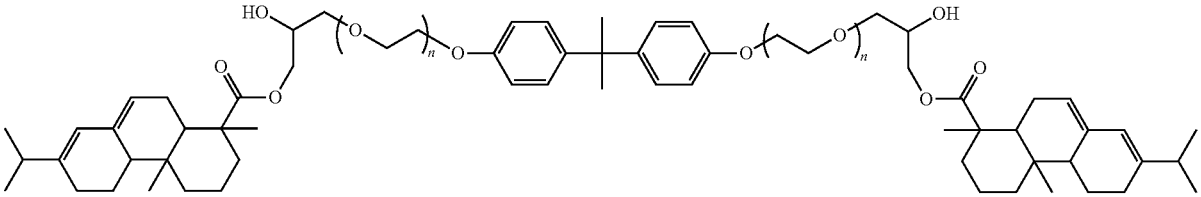

(3)

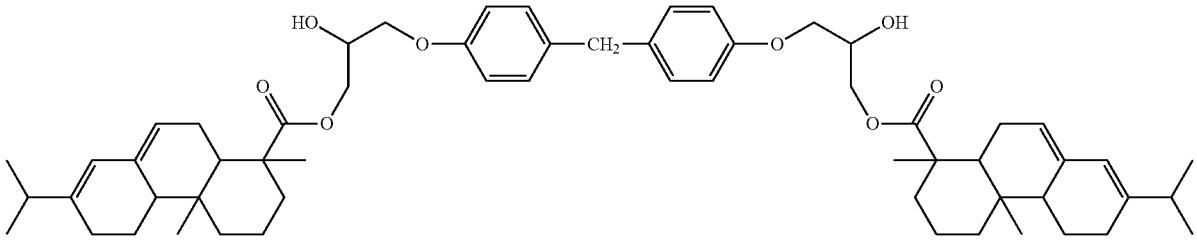

(4)

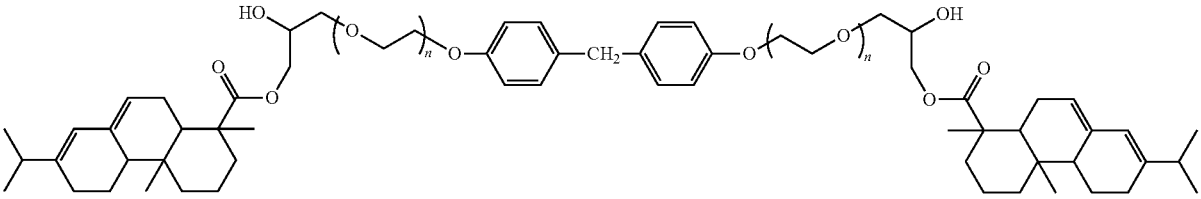

(5)

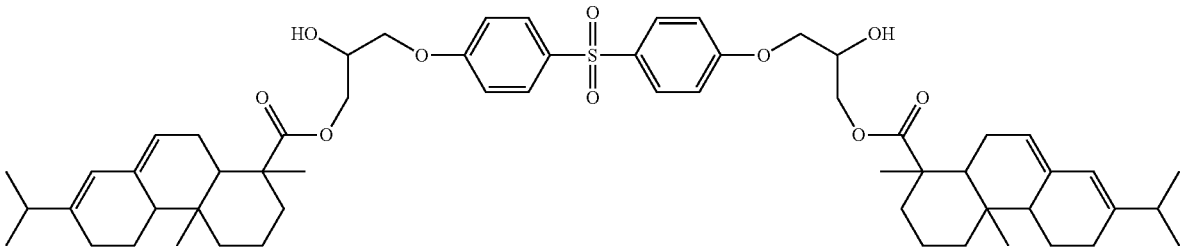

-continued
(6)
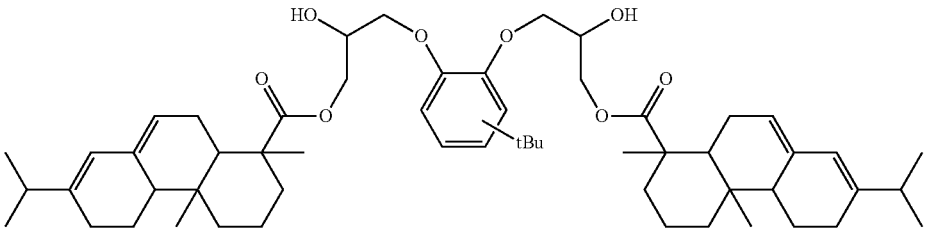
(7)
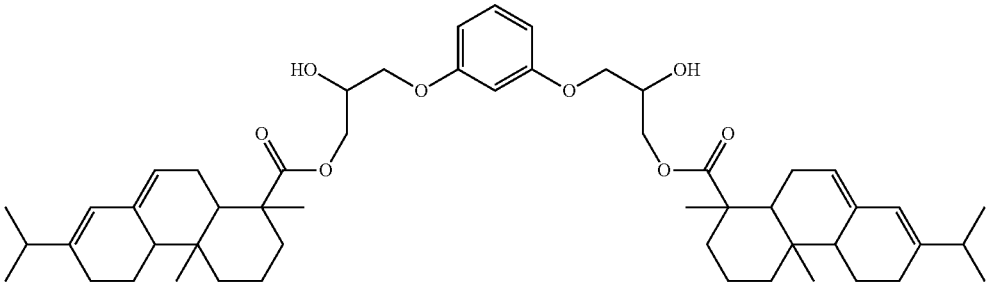
(8)
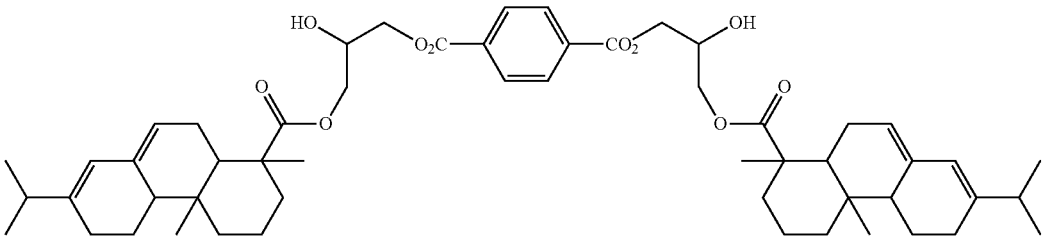
(9)
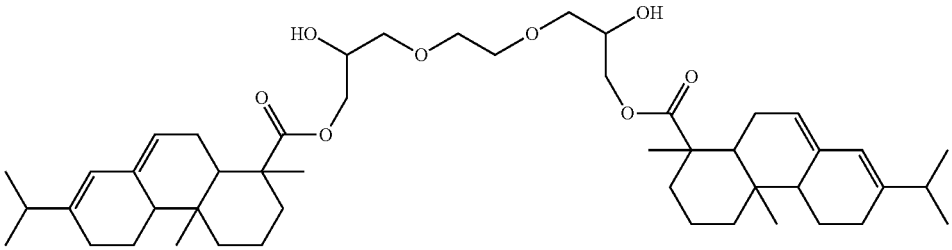
(10)
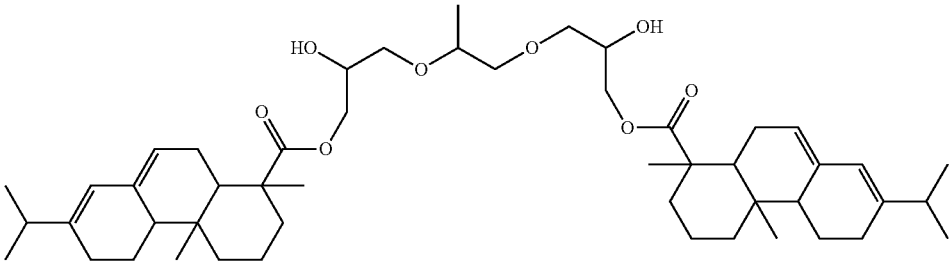
(12)
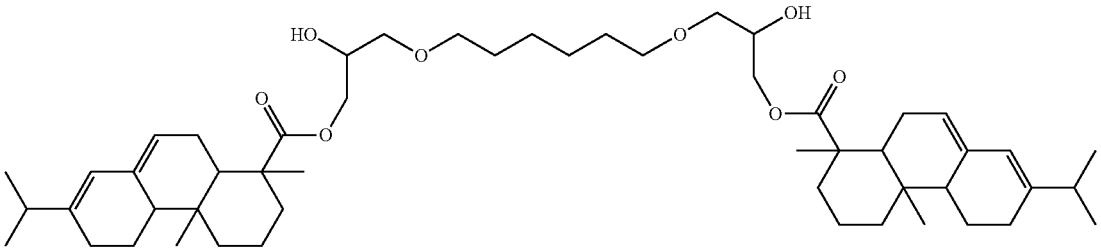

-continued
(13)
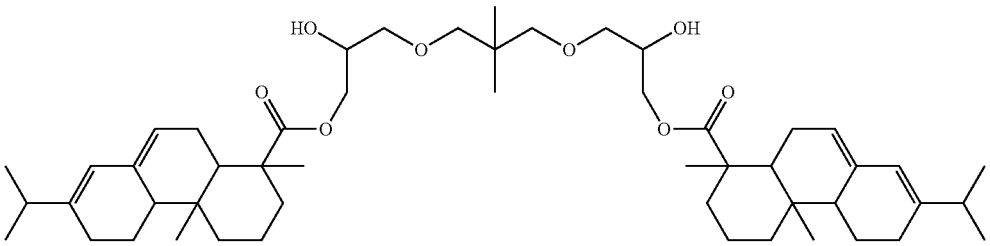
(14)
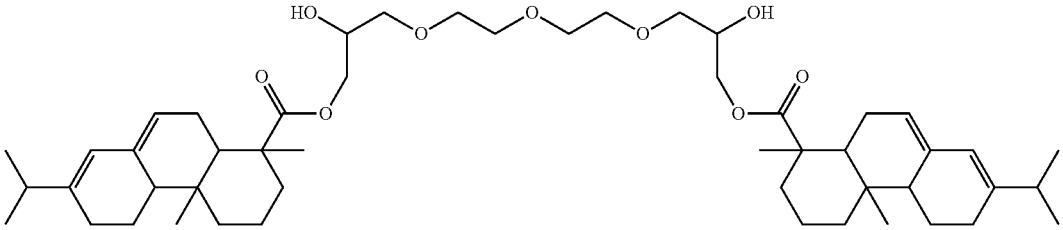
(15)
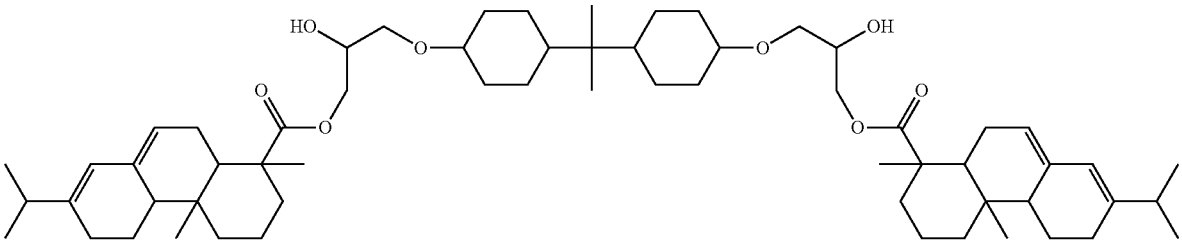
(16)
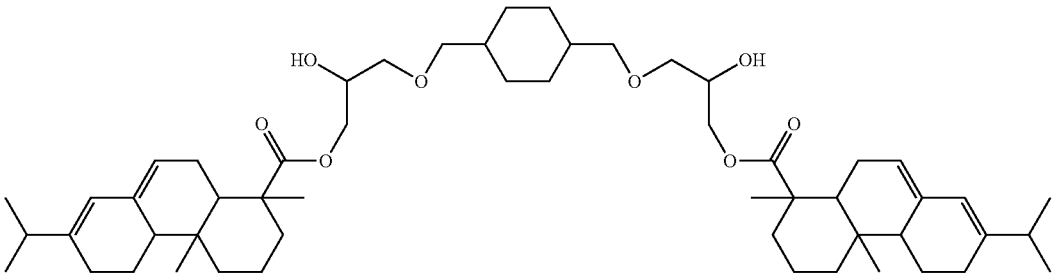
(17)
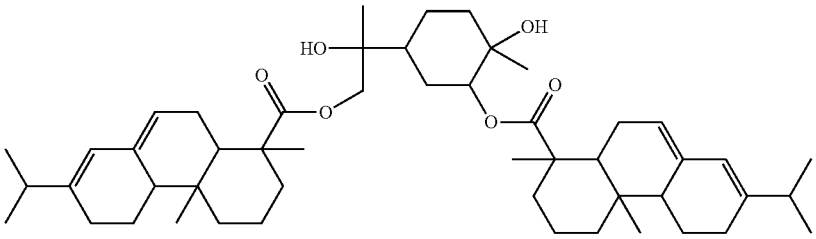
(18)
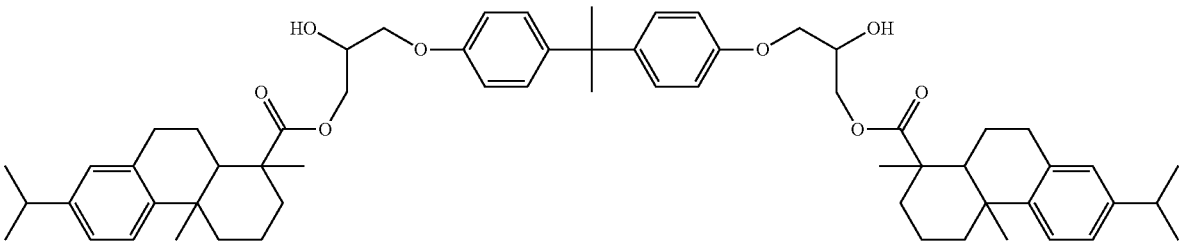

-continued
(19)
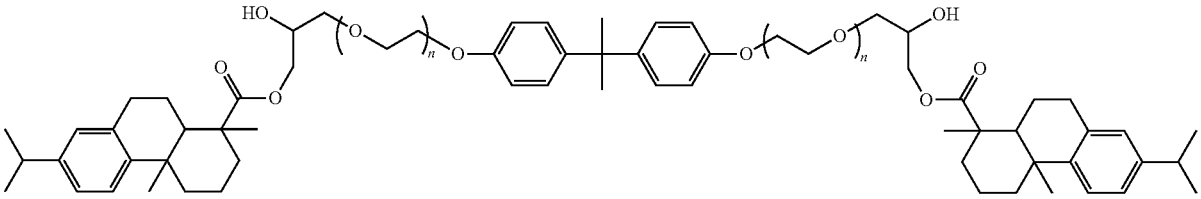
(20)
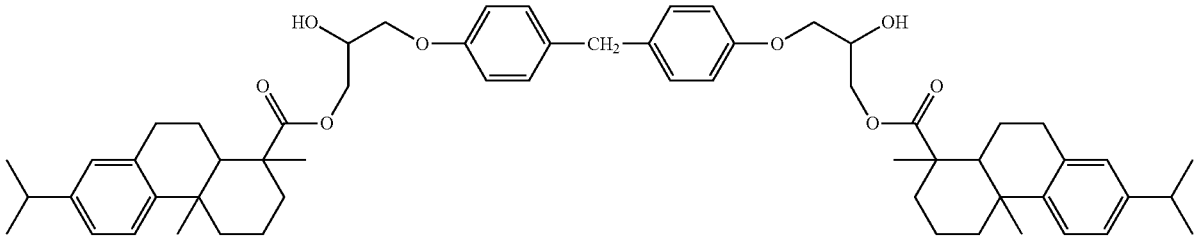
(21)
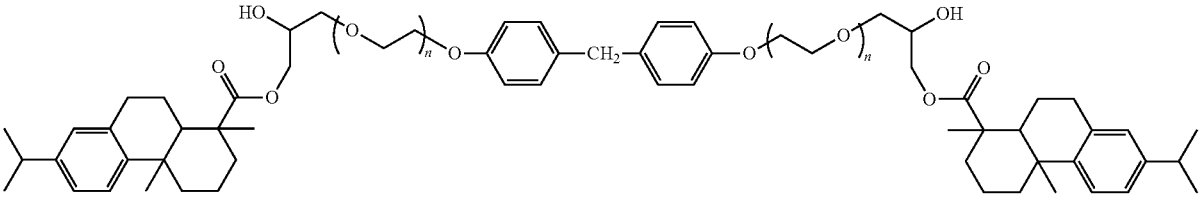
(22)
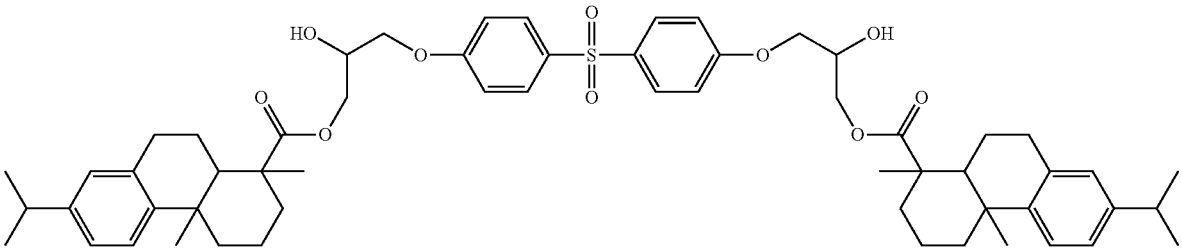
(23)
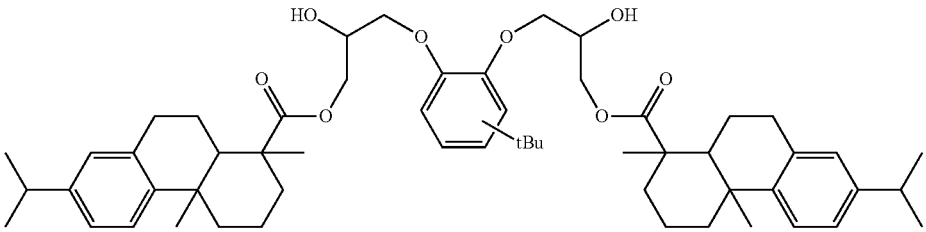
(24)
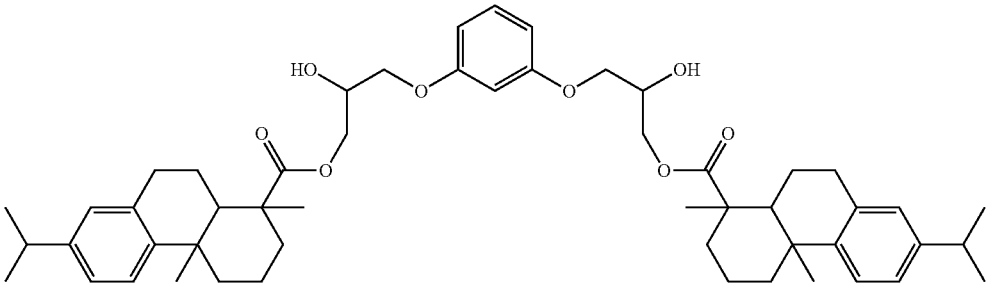

-continued
(25)
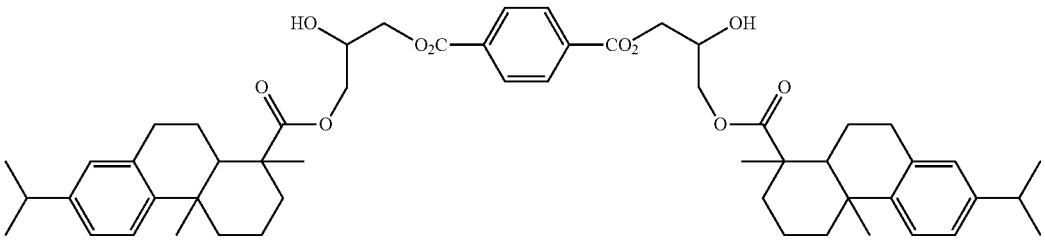
(26)
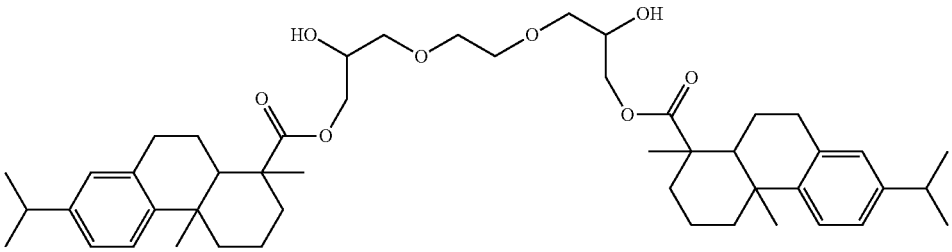
(27)
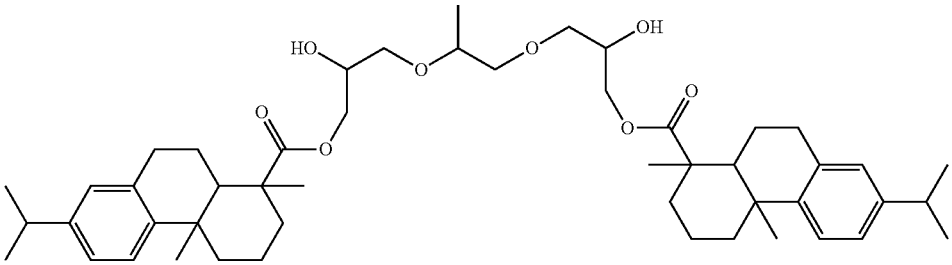
(28)
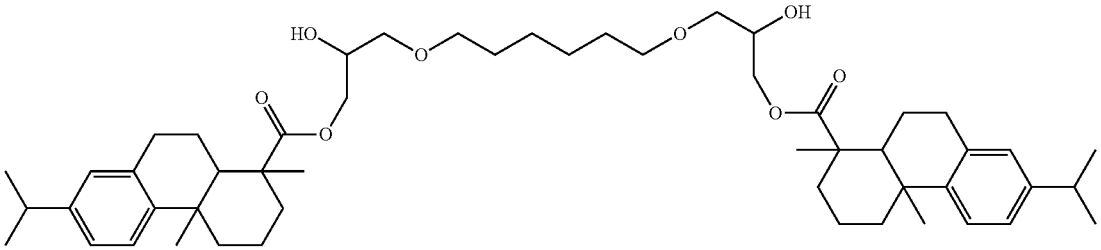
(29)
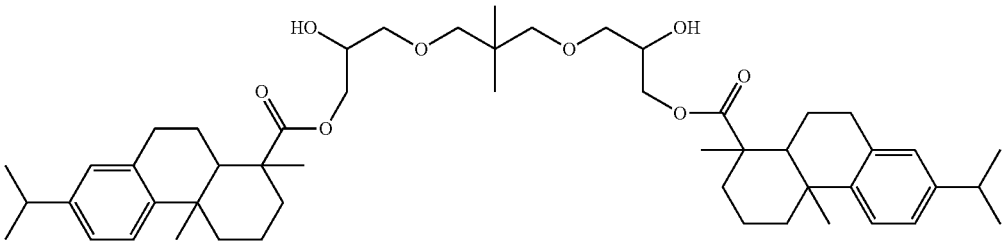
(30)
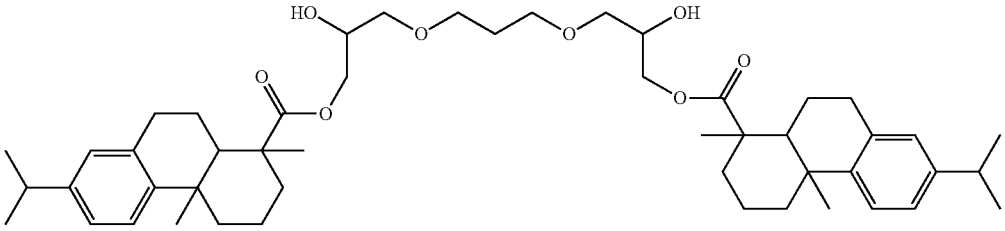

-continued
(31)
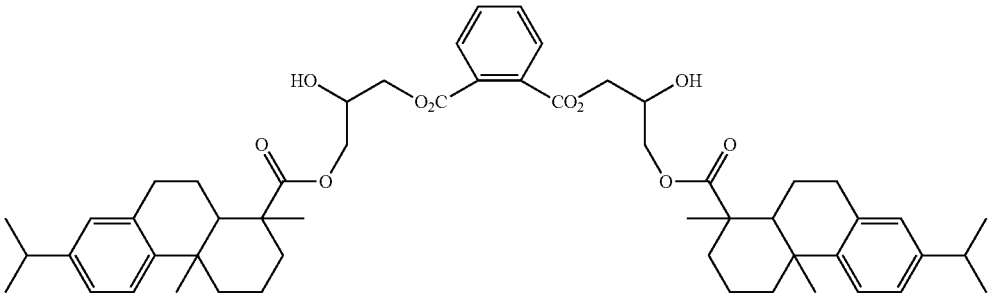
(32)
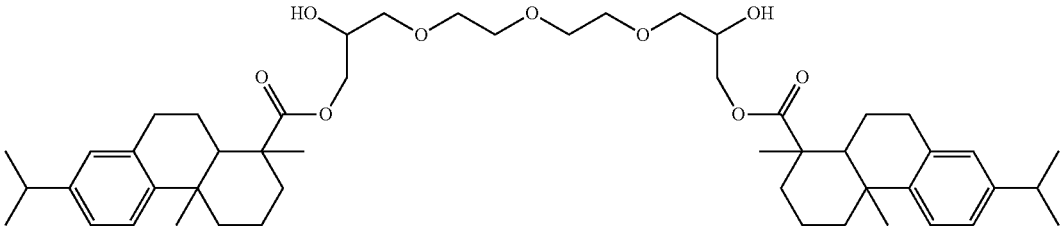
(33)
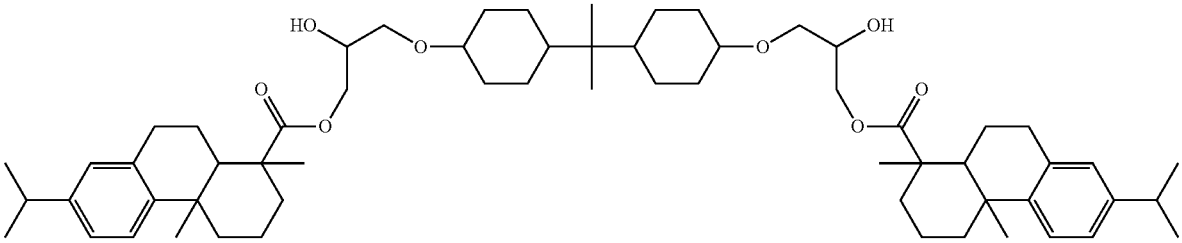
(34)
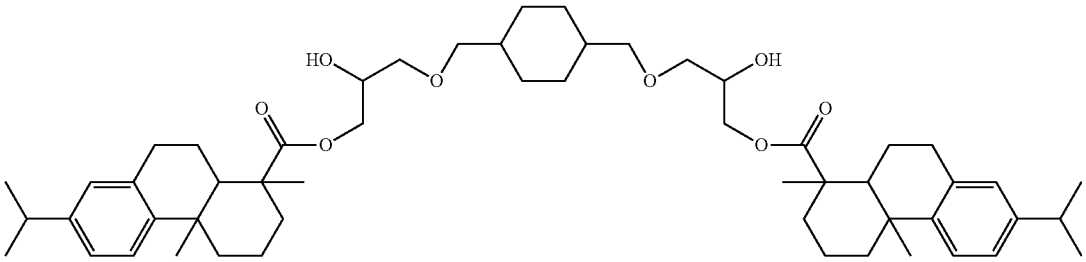
(35)
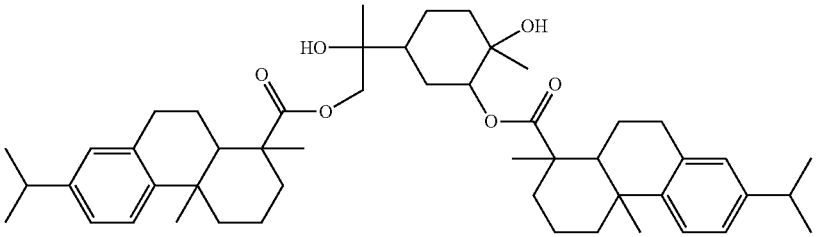
(36)
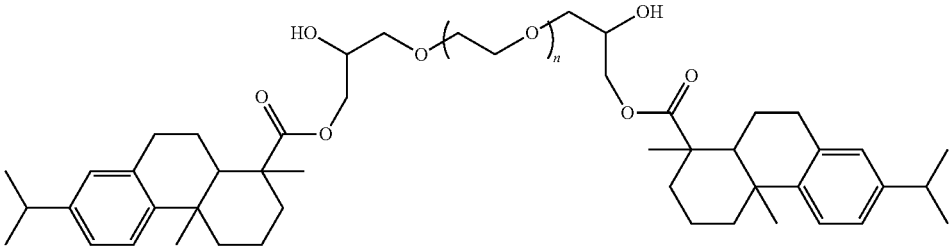

-continued
(37)
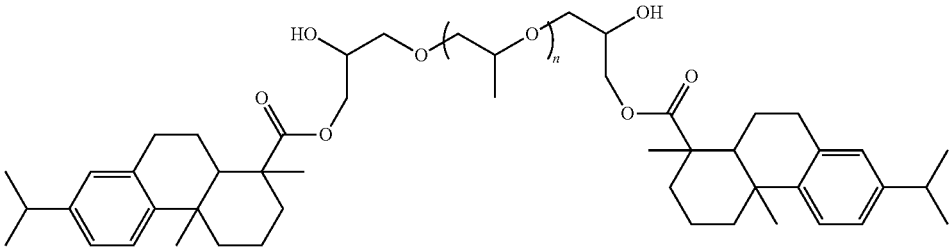
(38)
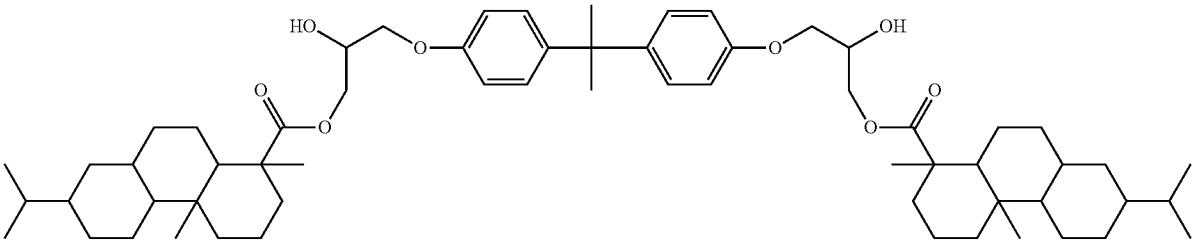
(39)
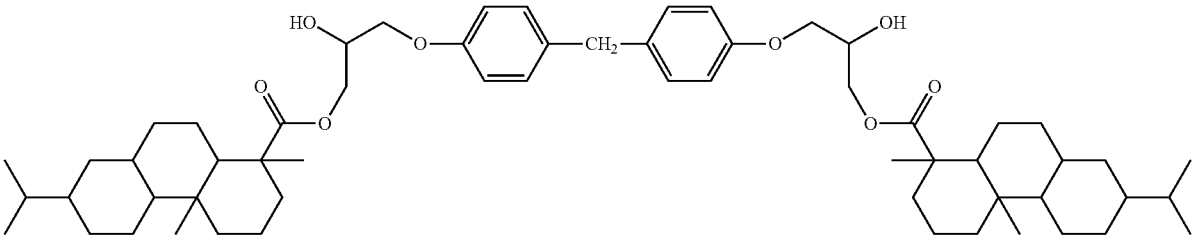
(40)
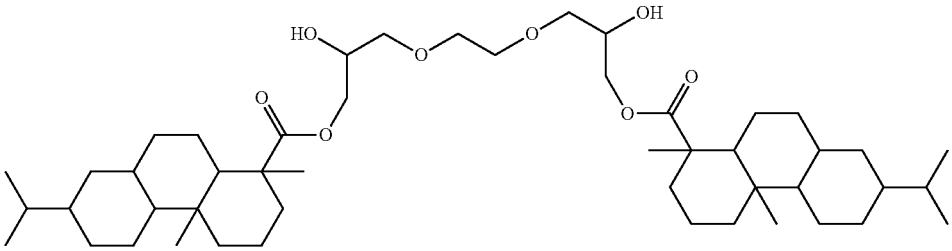
(41)
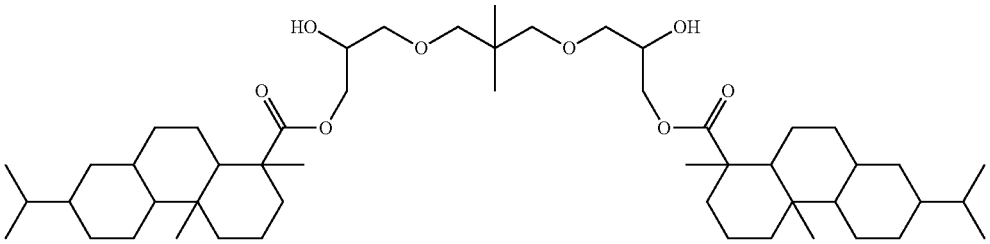
(42)
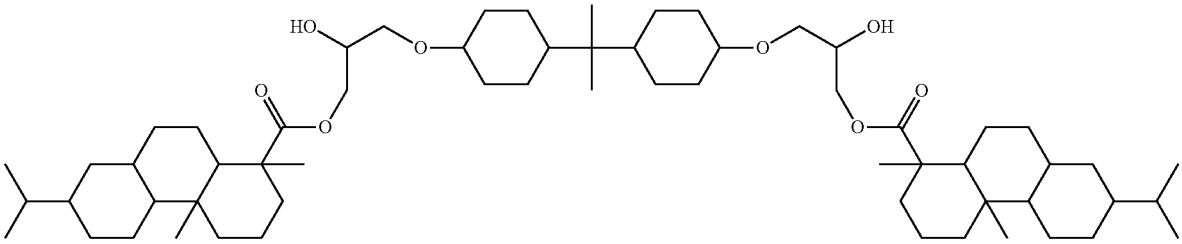

where n is an integer of 1 or more.

In this exemplary embodiment, the particular rosin diol may be used in combination with other alcohols. For high fixing strength, the content of the particular rosin diol is preferably 10 to 100 mol %, more preferably 20 to 90 mol %, of the alcohol component.

As other alcohols, at least one alcohol selected from the group consisting of aliphatic diols and aromatic diols may be used as long as they do not decrease the toner performance.

Examples of aliphatic diols include, but not limited to, ethylene glycol, 1,2-propanediol, 1,3-propanediol, 1,2-butanediol, 1,3-butanediol, 1,4-butanediol, 2,3-butanediol, 1,4-butenediol, 2-methyl-1,3-propanediol, 1,5-pentanediol, neopentyl glycol, 2-ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-dimethyl-1,5-pentanediol, 2,2,4-trimethyl-1,3-pentanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosadecanediol, dimer diol, 3-hydroxy-2,2-dimethylpropyl-3-hydroxy-2,2-dimethylpropanoate, diethylene glycol, triethylene glycol, polyethylene glycol, dipropylene glycol, and polypropylene glycol.

Examples of aromatic diols include, but not limited to, ethylene oxide adducts of bisphenol A, propylene oxide adducts of bisphenol A, and butylene oxide adducts of bisphenol A.

These compounds may be used alone or in combination.

In this exemplary embodiment, aliphatic diols may be used together with etherified diphenols. Etherified diphenols are prepared by addition reaction of bisphenol A with an alkylene oxide. The alkylene oxide is, for example, ethylene oxide or propylene oxide. The average molar ratio of the alkylene oxide to bisphenol A may be 2 to 16.

Next, the carboxylic acid component, which is one of the polycondensation components of the particular rosin-based polycondensate, will be described.

The carboxylic acid component may be a polycarboxylic acid. For example, the carboxylic acid component may be at least one dicarboxylic acid selected from the group consisting of aromatic dicarboxylic acids and aliphatic dicarboxylic acid. Examples of dicarboxylic acids include aromatic dicarboxylic acids such as phthalic acid, isophthalic acid, terephthalic acid, 1,4-naphthalenedicarboxylic acid, and 2,6-naphthalenedicarboxylic acid; aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, dimer acids, alkyl succinic acids having a branched alkyl having 1 to 20 carbon atoms, and alkenyl succinic acids having a branched alkenyl having 1 to 20 carbon atoms; and anhydrides and alkyl (having 1 to 3 carbon atoms) esters thereof. In particular, aromatic carboxylic acids are preferred for high toner durability and fixability and high colorant dispersibility.

Examples of tri- and higher carboxylic acids include particular aromatic carboxylic acids such as 1,2,3-benzenetricarboxylic acid, 1,2,4-benzenetricarboxylic acid, and 1,2,4-naphthalenetricarboxylic acid and anhydrides and lower alkyl esters thereof. These compounds may be used alone or in combination.

In addition to the aliphatic dicarboxylic acid or aromatic dicarboxylic acid, the carboxylic acid component may contain a dicarboxylic acid having a sulfonic acid group.

A method for manufacturing the particular rosin-based polycondensate will now be described.

The particular rosin-based polycondensate according to this exemplary embodiment may be manufactured from the carboxylic acid component and the alcohol component including the particular rosin diol in a known manner. The reaction may be either transesterification reaction or direct esterification reaction. Polycondensation may be promoted by raising the reaction temperature under pressure or by supplying an inert gas under reduced pressure or normal pressure. The reaction may be promoted using a known reaction catalyst, for example, at least one metal compound selected from the group consisting of antimony, titanium, tin, zinc, aluminum, and manganese compounds, depending on the reaction. The amount of reaction catalyst added is preferably 0.01 to 1.5 parts by mass, more preferably 0.05 to 1.0 part by mass, per 100 parts by mass of the total amount of polycarboxylic acid and polyalcohol. The reaction temperature is, for example, 180° C. to 300° C.

The properties of the particular rosin-based polycondensate will now be described.

For high toner durability and offset resistance, the particular rosin-based polycondensate preferably has a weight average molecular weight of 1,000 to 50,000, more preferably 1,500 to 20,000.

The weight average molecular weight may be measured in the following manner.

The measurement is performed using HLC-8120GPC and SC-8020 (available from Tosoh Corporation) with two columns (6.0 mm ID×15 cm) and tetrahydrofuran (THF) as an eluent. The experimental conditions are as follows: the sample concentration is 0.5%, the flow rate is 0.6 mL/min, the injection volume is 10 L, the measurement temperature is 40° C., and the detector is a refractive index (RI) detector. The calibration curve is generated from the following ten samples: TSK Standard Polystyrene A-500, F-1, F-10, F-80, F-380, A-2500, F-4, F-40, F-128, and F-700 (available from Tosoh Corporation).

For high toner fixability, storage stability, and durability, the particular rosin-based polycondensate preferably has a softening temperature of 80° C. to 160° C., more preferably 90° C. to 150° C.

The softening temperature is measured using a CFT-500 flow tester (available from Shimadzu Corporation). A sample with a size of 1 $cm^3$ is melted and allowed to flow through a die having a pore diameter of 0.5 mm under a load of 0.98 MPa (10 $Kg/cm^2$) at a heating rate of 1° C./min. The softening temperature is determined as the temperature corresponding to half the height from the starting point to the end point of the flow.

For high fixability, storage stability, and durability, the particular rosin-based polycondensate preferably has a glass transition temperature of 35° C. to 80° C., more preferably 40° C. to 70° C. The softening temperature and the glass transition temperature may be adjusted depending on the compositions of the starting monomers, the polymerization initiator, the molecular weight, the amount of catalyst, and the reaction conditions.

The glass transition temperature may be measured using DSC-20 (available from Seiko Instruments Inc.) by heating 10 mg of a sample at a heating rate of 10° C./min.

The particular rosin-based polycondensate preferably has an acid value of 1 to 50 mg KOH/g, more preferably 3 to 30 mg KOH/g.

The acid value may be measured by neutralization titration according to JIS K0070. Specifically, a suitable amount of sample is mixed with 100 mL of a solvent (mixture of diethyl ether and ethanol) and a few drops of an indicator (phenolphthalein solution). The solution is sufficiently stirred on a water bath until the sample dissolves. The solution is then titrated with a 0.1 mol/L potassium hydroxide ethanol solution. The titration is terminated when the indicator remains red for 30 seconds. The acid value is calculated by the equation A=(B×f×5.611)/S, where A is the acid value, S is the amount of sample (g), B is the amount of 0.1 mol/L potassium hydroxide ethanol solution used for titration (mL), and f is the factor for the 0.1 mol/L potassium hydroxide ethanol solution.

The particular rosin-based polycondensate may be a modified particular rosin-based polycondensate. Examples of modified particular rosin-based polycondensates include particular rosin-based polycondensates grafted or blocked with phenol, urethane, or epoxy by the methods disclosed in Japanese Unexamined Patent Application Publication Nos. 11-133668, 10-239903, and 8-20636.

The isocyanate-containing compound will now be described.

The isocyanate-containing compound may be an isocyanate-containing monomer or polymer.

The isocyanate-containing compound typically has 1 or more isocyanate groups (average), preferably 1.5 to 3 isocyanate groups, more preferably 1.8 to 2.5 isocyanate groups.

If the isocyanate-containing compound has less than 1 isocyanate group, the particular polyester resin, which is formed by elongation reaction, crosslinking reaction, or a combination thereof, would have low molecular weight and therefore low offset resistance.

Examples of isocyanate-containing monomers include tolylene diisocyanate, hydrogenated tolylene diisocyanate, diphenylmethane diisocyanate, xylene diisocyanate, hexamethylene diisocyanate, and isophorone diisocyanate.

Particularly preferred are isophorone diisocyanate, hexamethylene diisocyanate, more preferably isophorone diisocyanate.

Examples of isocyanate-containing polymers include isocyanate prepolymers (polymer intermediates prepared by reaction of a polyol such as a hydroxyl-containing polyester or hydroxyl-containing polyether with an excess of polyisocyanate) and isocyanate-containing particular rosin-based polycondensates.

Particularly preferred for high thermal resistance and low-temperature fixability are isocyanate-containing particular rosin-based polycondensates and other isocyanate-containing polyesters, more preferably isocyanate-containing particular rosin-based polycondensates.

An isocyanate-containing polymer may be prepared by, for example, reacting a polymer such as a prepolymer or particular rosin-based polycondensate with an isocyanate-containing monomer by heating.

The molecular structure (particularly, urethane bonds) of the particular polyester resin may be determined in the following manner.

First, 2 g of the toner is dispersed in 40 mL of a 0.2% by mass surfactant (polyoxyethylene octylphenyl ether, available from Wako Pure Chemical Industries, Ltd.) aqueous solution. The solution is sonicated using a US-300TCVP ultrasonic generator (available from Nihonseiki Kaisha Ltd.) at an output power of 60 W and a frequency of 20 kHz for 60 minutes to remove the surface additive from the surface of the toner.

After sonication, the toner particles are filtered out of the dispersion. The sample is analyzed by a method such as carbon-13 nuclear magnetic resonance spectroscopy ($^{13}$C-NMR), Fourier transform infrared spectroscopy (FT-IR), or pyrolysis chromatography-mass spectroscopy to determine the molecular structure (particularly, urethane bonds) of the particular polyester resin.

Alternatively, the molecular structure may be determined by analyzing hydrolysates because the resin is hydrolyzed into monomers.

Other Resins

The particular polyester resin may be used in combination with other binder resins such as amorphous resins and crystalline resins as long as they do not impair the advantages of this exemplary embodiment.

The content of the particular polyester resin is preferably 70 parts by mass or more, more preferably 90 parts by mass or more, per 100 parts by mass of all binder resins.

The other resins may be resins having no group that reacts with an isocyanate group.

As used herein, the term "amorphous resin" refers to a resin that exhibits a stepwise change in heat capacity, rather than a clear endothermic peak, in differential scanning calorimetry (DSC) and that is solid at room temperature (e.g., 25° C.) and plasticizes above the glass transition temperature thereof.

The term "crystalline resin" refers to a resin that exhibits a clear endothermic peak, rather than a stepwise change in heat capacity, in DSC.

Specifically, for example, the term "crystalline resin" refers to a resin having an endothermic peak whose half-width measured at a heating rate of 10° C./min falls below 10° C., whereas the term "amorphous resin" refers to a resin having an endothermic peak whose half-width exceeds 10° C. or no clear endothermic peak.

Examples of crystalline resins include crystalline polyester resins, polyalkylene resins, and long-chain alkyl (meth)acrylate resins. In particular, crystalline polyester resins are preferred because they exhibit an abrupt change in viscosity when heated and also provide a balance of mechanical strength and low-temperature fixability.

For high low-temperature fixability, for example, the crystalline resin may be a polycondensate of an aliphatic dicarboxylic acid (or an anhydride or chloride thereof) and an aliphatic diol.

The content of the crystalline resin is preferably 1 to 20 parts by mass, more preferably 5 to 15 parts by mass, per 100 parts by mass of all binder resins.

Examples of amorphous resins include known binder resins, for example, vinyl resins such as styrene-acrylic resins, epoxy resins, polycarbonates, and polyurethanes.

Colorant

The colorant may be either a dye or a pigment. For example, pigments are preferred for high light resistance and water resistance.

Examples of colorants include known pigments such as carbon black, aniline black, aniline blue, calco oil blue, chrome yellow, ultramarine blue, DuPont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The colorant may optionally be surface-treated or be used in combination with a pigment dispersant.

The type of colorant may be selected to prepare various toners such as yellow, magenta, cyan, and black toners.

The content of the colorant may be 1 to 30 parts by mass per 100 parts by mass of the binder resin.

Release Agent

Examples of release agents include paraffin waxes such as low-molecular-weight polypropylene and low-molecular-weight polyethylene; silicone resins; rosins; rice wax; and carnauba wax. The release agent preferably has a melting temperature of 50° C. to 100° C., more preferably 60° C. to 95° C. The content of the release agent in the toner is preferably 0.5% to 15% by mass, more preferably 1.0% to 12% by mass. If the content of the release agent is 0.5% by mass or more, peel defects may be prevented, particularly for oil-free fixing. If the content of the release agent is 15% by mass or less, the toner may provide improved reliability in terms of image quality and image formation without decreased liquidity.

Other Additives

Known charge control agents may be used, including azo metal complexes, metal salicylate complexes, and resins having a polar group.

Properties of Toner Particles

The toner particles may be single-layer toner particles or core-shell toner particles, which are composed of cores (core particles) and shells (shell layers) covering the cores.

Core-shell toner particles may be composed of, for example, cores containing a binder resin containing a particular polyester resin and optionally a colorant, a release agent, and other additives and shells containing a particular polyester resin or another resin.

The toner particles preferably have a volume average particle size of, for example, 2.0 to 10 μm, more preferably 3.5 to 7.0 μm.

The volume average particle size of the toner particles may be measured in the following manner. To 2 mL of an aqueous solution containing 5% by mass of a surfactant, such as sodium alkylbenzenesulfonate, as a dispersant, is added 0.5 to 50 mg of a sample. The solution is then added to 100 to 150 mL of the electrolyte solution. The sample suspended in the electrolyte solution is dispersed using a sonicator for one minute. After the treatment, the particle size distribution of particles having particle sizes of 2.0 to 60 μm is measured using a Coulter Multisizer II (available from Beckman Coulter, Inc.) with an aperture diameter of 100 μm. The measurement is performed on 50,000 particles.

The resulting particle size distribution is divided into particle size ranges (channels). The volume average particle size D50v is determined as the particle size at which the cumulative volume obtained by subtracting the cumulative volume distribution from the smaller particle size side is 50%.

The toner particles preferably have a shape factor SF1 of, for example, 110 to 150, more preferably 120 to 140.

The shape factor SF1 may be calculated by equation (1):

$$SF1=(ML^2/A)\times(\pi/4)\times 100 \quad (1)$$

where ML is the absolute maximum length of the toner, and A is the projected area of the toner.

The shape factor SF1 may be calculated by analyzing a micrograph such as a photomicrograph or scanning electron micrograph (SEM) using an image analyzer to convert it into numerical form. For example, the shape factor SF1 is calculated as follows. A photomicrograph of particles dispersed over a glass slide is captured by a video camera and is fed to a LUZEX image analyzer. The maximum lengths and projected areas of 100 particles are measured, and the shape factors SF1 thereof are calculated by equation (1) and are averaged.

Surface Additive

Examples of surface additives include inorganic particles such as $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles used as the surface additive may be hydrophobized in advance. The surface of the inorganic particles may be hydrophobized by, for example, dipping the particles in a hydrophobing agent. Examples of hydrophobing agents include, but not limited to, silane coupling agents, silicone oils, titanate coupling agents, and aluminum coupling agents. These materials may be used alone or in combination.

The amount of hydrophobing agent is typically, for example, about 1 to 10 parts by mass per 100 parts by mass of the inorganic particles.

Other examples of surface additives include resin particles (e.g., polystyrene, poly(methyl methacrylate) (PMMA), or melamine resin particles), cleaning active agents (e.g., metal salts of higher fatty acids, such as zinc stearate, and fluorinated polymer powders).

The amount of surface additive added is, for example, 0.01 to 5 parts by mass, more preferably 0.01 to 2.0 parts by mass, per 100 parts by mass of the toner particles.

Method for Manufacturing Toner

The toner according to this exemplary embodiment may be manufactured by any known process, either by a dry process (e.g., pulverization) or by a wet process (e.g., aggregation coalescence, suspension polymerization, solution suspension granulation, solution suspension, or solution emulsion aggregation coalescence).

For improved peel strength of fixed images, the toner according to this exemplary embodiment may be manufactured by a wet process such as solution suspension.

A toner manufactured by a wet process such as solution suspension may have a smaller particle size than a toner manufactured by pulverization. Thus, the toner may more easily enter pits on a recording medium and may thus have a higher permeability to recording media.

A method for manufacturing the toner according to this exemplary embodiment by solution suspension will now be described by way of example.

This method involves dissolving at least the particular polyester resin in an organic solvent to prepare an organic solvent solution, suspending the organic solvent solution in an aqueous solvent to prepare a suspension, and removing the organic solvent from the suspension.

First, the particular polyester resin is dissolved as a binder resin in an organic solvent to prepare an organic solvent solution. Optionally, other additives are added to the organic solvent.

The organic solvent may be a common organic solvent. Examples of organic solvents include hydrocarbons such as toluene, xylene, and hexane; halogenated hydrocarbons such as methylene chloride, chloroform, and dichloroethane; alcohols such as methanol and ethanol; ethers such as tetrahydrofuran; esters such as methyl acetate, ethyl acetate, and butyl acetate; and ketones such as acetone, methyl ethyl ketone, and cyclohexanone. These solvents may be used alone or as a mixture.

The organic solvent may be used in any amount sufficient to prepare an organic solvent solution with a viscosity suitable for forming particles in the suspension. Preferably, the amount of organic solvent used is 50 to 5,000 parts by mass, more preferably 120 to 1,000 parts by mass, per 100 parts by mass of the total amount of binder resin.

Next, the organic solvent solution is suspended in an aqueous solvent using an emulsifier equipped with a propeller to prepare a suspension in which particles are formed.

Specifically, the kneaded mixture is dispersed in an aqueous dispersion medium using a disperser and is sheared while decreasing the viscosity of the binder resin by heating to prepare a suspension of the kneaded mixture (dispersion in which particles are dispersed). Examples of dispersers include homogenizers, homomixers, pressure kneaders, extruders, and media dispersers.

The aqueous solvent used for the suspension may be water or a mixture of water and a water-soluble solvent. Examples of water-soluble solvents include alcohols such as methanol and ethanol and acetone.

The droplets suspended in the organic solvent solution preferably have a volume average particle size of 3.0 to 9.0 μm, more preferably 4.0 to 8.0 μm.

To form such suspended droplets, a disperser capable of stirring by shearing, as described above, may be used.

A dispersant may be used to stabilize the suspension or to thicken the aqueous solvent. Examples of dispersants include water-soluble polymers such as polyvinyl alcohol, methylcellulose, ethylcellulose, hydroxyethylcellulose, carboxymethylcellulose, sodium polyacrylate, and sodium polymethacrylate; anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; amphoteric surfactants such as lauryldimethylamine oxide; nonionic surfactants such as polyoxyethylene alkyl ether, polyoxyethylene alkyl phenyl ether, polyoxyethylene alkylamine; and inorganic salts such as tricalcium phosphate, aluminum hydroxide, calcium sulfate, calcium carbonate, and barium carbonate.

If an inorganic compound is used as a dispersant, a commercially available product may be used as purchased. Alternatively, to form particles, inorganic compound particles may be formed in the aqueous solvent.

The amount of dispersant used may be 0.01 to 20 parts by mass per 100 parts by mass of the binder resin.

A water-soluble polymer may be added to the aqueous solvent as a dispersion stabilizer. Examples of dispersion stabilizers include cellulose, hydroxypropylmethylcellulose, methylcellulose, carboxymethylcellulose, starch, polyvinyl alcohol, polyacrylic acid, salts thereof with alkali metals such as sodium and potassium, and salts thereof with alkaline earth metals such as calcium and magnesium.

Next, the organic solvent is removed. The organic solvent may be removed by, for example, controlling the external pressure.

In this exemplary embodiment, the removal of the organic solvent may be followed by cleaning with, for example, hydrochloric acid. Thus, residue, such as the inorganic dispersant, may be removed from the surface of the toner particles to restore the original toner composition for improved properties.

The toner particles are then dried. The toner particles may be dried using any known dryer such as a through-air dryer, spray dryer, rotary dryer, flash dryer, fluidized-bed dryer, heat transfer dryer, or freeze dryer.

The toner according to this exemplary embodiment is manufactured by, for example, mixing the dried toner particles with a surface additive. The toner particles may be mixed using, for example, a V-blender, Henschel mixer, or Loedige mixer. Optionally, coarse toner particles may be removed using, for example, a vibratory separator or wind separator.

Electrostatic Image Developer

An electrostatic image developer according to an exemplary embodiment contains at least a toner according to an exemplary embodiment.

The electrostatic image developer according to this exemplary embodiment may be a one-component developer containing only a toner according to an exemplary embodiment or a two-component developer containing the toner and a carrier.

Examples of carriers include, but not limited to, known carriers such as resin-coated carriers, magnetic-powder-dispersed carriers, and resin-dispersed carriers.

For two-component developers, the mixing ratio (by mass) of the toner to the carrier is preferably about 1:100 to 30:100, more preferably about 3:100 to 20:100.

Image-Forming Apparatus and Method for Forming Image

Next, an image-forming apparatus and a method for forming an image according to exemplary embodiments will be described.

An image-forming apparatus according to an exemplary embodiment includes an image carrier, a charging unit that charges the image carrier, an electrostatic-image forming unit that forms an electrostatic image on the charged image carrier, a developing unit that contains an electrostatic image developer and that develops the electrostatic image formed on the image carrier with the electrostatic image developer to form a toner image, a transfer unit that transfers the toner image from the image carrier to a transfer medium, and a fixing unit that fixes the toner image to the transfer medium. The electrostatic image developer is an electrostatic image developer according to an exemplary embodiment.

In the image-forming apparatus according to this exemplary embodiment, a section including, for example, the developer unit may be configured as a cartridge (process cartridge) attachable to and detachable from the image-forming apparatus. For example, the image-forming apparatus according to this exemplary embodiment may use a process cartridge that includes the developing unit and that contains an electrostatic image developer according to an exemplary embodiment.

A method for forming an image according to an exemplary embodiment includes charging an image carrier, forming an electrostatic image on the charged image carrier, developing the electrostatic image formed on the image carrier with an electrostatic image developer to form a toner image, transferring the toner image from the image carrier to a transfer medium, and fixing the toner image to the transfer medium. The electrostatic image developer is an electrostatic image developer according to an exemplary embodiment.

A non-limiting example of an image-forming apparatus according to this exemplary embodiment is illustrated below, where the relevant parts shown in the drawings are described, and the other parts are not described.

FIG. 1 is a schematic view of a four-color tandem image-forming apparatus. The image-forming apparatus illustrated in FIG. 1 includes first to fourth electrophotographic image-forming units (hereinafter referred to as "units") 10Y, 10M, 10C, and 10K that produce yellow (Y), magenta (M), cyan (C), and black (K) images, respectively, based on color separation image data. The units 10Y, 10M, 10C, and 10K are arranged in parallel at a predetermined distance from each other in the horizontal direction. The units 10Y, 10M, 10C, and 10K may be process cartridges attachable to and detachable from the image-forming apparatus.

An intermediate transfer belt 20, which is an example of an intermediate transfer member, extends over the units 10Y, 10M, 10C, and 10K in FIG. 1. The intermediate transfer belt 20 is entrained about a drive roller 22 and a support roller 24 disposed at a distance from each other in the direction from the left to the right in FIG. 1 in contact with the inner surface of the intermediate transfer belt 20. The intermediate transfer belt 20 travels in the direction from the first unit 10Y toward the fourth unit 10K. The support roller 24 is biased in the direction away from the drive roller 22, for example, by a spring (not shown), to apply tension to the intermediate transfer belt 20 entrained about the two rollers 22 and 24. An intermediate-transfer-member cleaning device 30 is disposed opposite the drive roller 22 on the image carrier side of the intermediate transfer belt 20.

The units 10Y, 10M, 10C, and 10K include developing devices (developing units) 4Y, 4M, 4C, and 4K, respectively, to which yellow, magenta, cyan, and black toners are supplied from toner cartridges 8Y, 8M, 8C, and 8K, respectively.

The first to fourth units 10Y, 10M, 10C, and 10K have the same structure. The description herein will concentrate on the first unit 100Y, which forms a yellow image and which is located upstream in the travel direction of the intermediate transfer belt 20. The elements of the second to fourth units 10M, 10C, 10K corresponding to those of the first unit 100Y are designated by like numerals followed by "M" (magenta), "C" (cyan), and "K" (black), respectively, rather than "Y" (yellow), and are not described herein.

The first unit 10Y includes a photoreceptor 1Y that functions as an image carrier. The photoreceptor 1Y is surrounded by, in sequence, a charging roller 2Y that charges the surface of the photoreceptor 1Y to a predetermined potential, an exposure device (electrostatic-image forming unit) 3 that exposes the charged surface to a laser beam 3Y based on a color separation image signal to form an electrostatic image, a developing device (developing unit) 4Y that supplies a charged toner to the electrostatic image to develop the electrostatic image, a first transfer roller (first transfer unit) 5Y that transfers the developed image to the intermediate transfer belt 20, and a photoreceptor-cleaning device (cleaning unit) 6Y that removes residual toner from the surface of the photoreceptor 1Y after the first transfer.

The first transfer roller 5Y is disposed opposite the photoreceptor 1Y inside the intermediate transfer belt 20. The first transfer rollers 5Y, 5M, 5C, and 5K have connected thereto bias power supplies (not shown) that apply a first transfer bias thereto. The bias power supplies are controlled by a controller (not shown) to change the transfer bias applied to the first transfer rollers 5Y, 5M, 5C, and 5K.

The yellow-image forming operation of the first unit 10Y will now be described. Before the operation, the charging roller 2Y charges the surface of the photoreceptor 1Y to a potential of about −600 to −800 V.

The photoreceptor 1Y includes a conductive substrate (having a volume resistivity at 20° C. of $1\times10^6$ Ωcm or less) and a photosensitive layer disposed on the substrate. The photosensitive layer, which normally has high resistivity (similar to the resistivities of common resins), has the property of changing its resistivity in a region irradiated with the laser beam 3Y. The exposure device 3 emits the laser beam 3Y toward the charged surface of the photoreceptor 1Y based on yellow image data received from the controller (not shown). The laser beam 3Y irradiates the photosensitive layer of the photoreceptor 1Y to form an electrostatic image having a yellow print pattern on the surface of the photoreceptor 1Y.

The electrostatic image is formed by the charge on the surface of the photoreceptor 1Y. Specifically, the electrostatic image is a negative latent image formed after the charge on the surface of the photoreceptor 1Y dissipates from the region irradiated with the laser beam 3Y as a result of a decrease in resistivity while remaining in the region not irradiated with the laser beam 3Y.

As the photoreceptor 1Y rotates, the electrostatic image formed on the photoreceptor 1Y is brought to a predetermined development position where the image is visualized (developed) by the developing device 4Y.

The developing device 4Y contains an electrostatic image developer according to an exemplary embodiment. The electrostatic image developer contains, for example, at least a yellow toner and a carrier. The yellow toner is charged by friction as it is stirred in the developing device 4Y. The yellow toner gains a charge of the same polarity (negative) as the photoreceptor 1Y and is carried by a developer roller (developer carrier). As the surface of the photoreceptor 1Y passes through the developing device 4Y, the yellow toner is electrostatically attracted to the discharged region of the surface of the photoreceptor 1Y to develop the latent image. The photoreceptor 1Y on which the yellow toner image is formed continues to rotate at a predetermined speed to transport the toner image to a predetermined first transfer position.

When the photoreceptor 1Y transports the yellow toner image to the first transfer position, a first transfer bias is applied to the first transfer roller 5Y. The toner image is then transferred from the photoreceptor 1Y to the intermediate transfer belt 20 by an electrostatic force acting from the photoreceptor 1Y toward the first transfer roller 5Y. This transfer bias has the opposite polarity (positive) to the toner (negative). In the first unit 10Y, for example, the transfer bias is controlled to about +10 μA by the controller (not shown).

The cleaning device 6Y removes and collects residual toner from the photoreceptor 1Y.

Also, the first transfer biases applied to the first transfer rollers 5M, 5C, and 5K of the second to fourth units 10M, 10C, and 10K are controlled in the same manner.

Thus, the intermediate transfer belt 20 to which the yellow toner image is transferred by the first unit 10Y is sequentially transported through the second to fourth units 10M, 10C, and 10K, which superimpose toner images of the respective colors on top of each other.

The intermediate transfer belt 20 on which the toner images of the four colors are superimposed through the first to fourth units 10Y, 10M, 10C, and 10K reaches a second transfer section. The second transfer section includes the intermediate transfer belt 20, the support roller 24 disposed in contact with the inner surface of the intermediate transfer belt 20, and a second transfer roller (second transfer unit) 26 disposed on the image carrier side of the intermediate transfer belt 20. A recording medium (transfer medium) P is fed into a nip between the support roller 24 and the second transfer roller 26 at a predetermined timing by a feed mechanism. A second transfer bias is then applied to the support roller 24. Because this transfer bias has the same polarity (negative) as the toner (negative), the toner image is transferred from the intermediate transfer belt 20 to the recording medium P by an electrostatic force acting from the intermediate transfer belt 20 toward the recording medium P. The second transfer bias is set depending on the resistance detected by a resistance detector (not shown) that detects the resistance of the second transfer section, and the voltage is controlled accordingly.

The recording medium P is then transported to a nip between a pair of fixing rollers in a fixing device (roller-type fixing unit) 28. The fixing device fixes the toner image to the recording medium P to form a fixed image.

Examples of transfer media to which toner images are transferred include plain paper for use with electrophotographic copiers and printers and OHP sheets.

For improved surface smoothness after fixing, transfer media having a smooth surface may be used. Examples of such transfer media include coated paper, such as resin-coated plain paper, and art paper for use in image formation.

The recording medium P to which the color image is fixed is transported to an eject section. Thus, the color-image forming operation is complete.

Although the illustrated image-forming apparatus is configured to transfer the toner images via the intermediate transfer belt 20 to the recording medium P, it may be configured in other manners. For example, the image-forming apparatus may be configured to directly transfer the toner images from the photoreceptors 1Y, 1M, 1C, and 1K to the recording medium P.

Process Cartridge and Toner Cartridge

Figure 2:
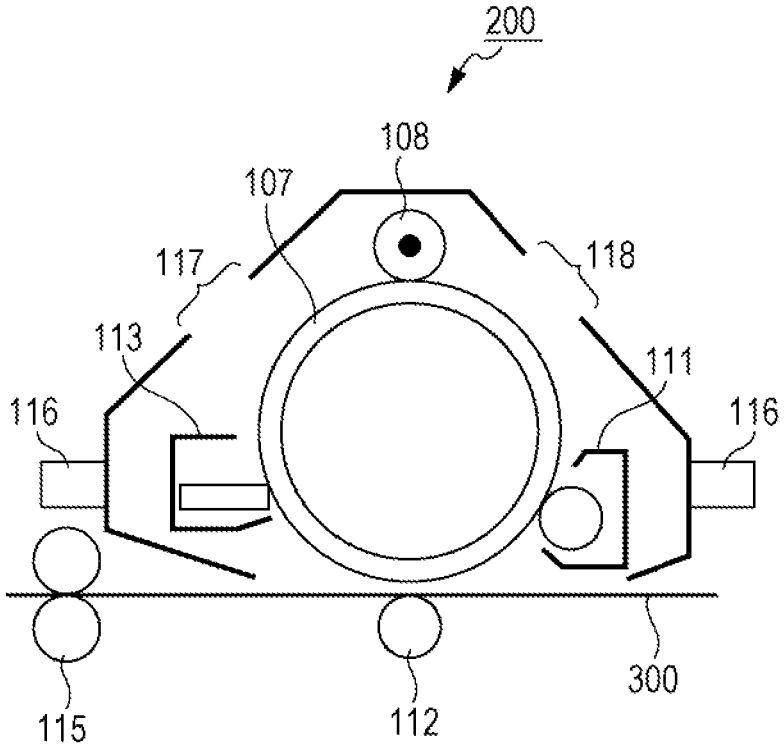
FIG. 2 is a schematic view of a process cartridge according to an exemplary embodiment.

FIG. 2 is a schematic view of a process cartridge containing an electrostatic image developer according to an exemplary embodiment. A process cartridge 200 includes a photoreceptor 107, a charging device 108, a developing device 111, a photoreceptor-cleaning device 113, an opening 118 for exposure, and an opening 117 for erase exposure. These devices are mounted on a mounting rail 116. A transfer medium 300 is also shown in FIG. 2.

The process cartridge 200 is attachable to and detachable from an image-forming apparatus including a transfer device 112, a fixing device 115, and other components (not shown).

Although the process cartridge 200 illustrated in FIG. 2 includes the charging device 108, the developing device 111, the cleaning device 113, the opening 118 for exposure, and the opening 117 for erase exposure, they may be selected in any combination. The process cartridge according to this exemplary embodiment includes the photoreceptor 107 and at least one selected from the group consisting of the charging device 108, the developing device 111, the cleaning device (cleaning unit) 113, the opening 118 for exposure, and the opening 117 for erase exposure.

Next, a toner cartridge according to an exemplary embodiment will be described. The toner cartridge according to this exemplary embodiment is attachable to and detachable from an image-forming apparatus and contains at least an electrostatic-image developing toner for supply to a developing unit disposed in the image-forming apparatus.

The image-forming apparatus illustrated in FIG. 1 includes the toner cartridges 8Y, 8M, 8C, and 8K, which are attachable thereto and detachable therefrom. The developing devices 4Y, 4M, 4C, and 4K are connected to the toner cartridges 8Y, 8M, 8C, and 8K, respectively, via toner supply tubes (not shown). The toner cartridges 8Y, 8M, 8C, and 8K are replaced when the toner level is low.

EXAMPLES

Exemplary embodiments are further illustrated by the following non-limiting examples, where parts and percentages are by mass unless otherwise indicated.

Synthesis of Particular Rosin Diol

Particular Rosin Diol 1: Hydrogenated Bisphenol A Rosin

In a stainless steel reaction container equipped with a stirrer, a heater, a condenser, and a thermometer are charged 107 parts by mass of hydrogenated bisphenol A diglycidyl ether (EX-252 from Nagase ChemteX Corporation), as a difunctional epoxy compound, 200 parts by mass of disproportionated rosin (PINECRYSTAL KR-614 from Arakawa Chemical Industries, Ltd.), as a rosin component, and 0.4 part by mass of tetraethylammonium bromide (from Tokyo Chemical Industry Co., Ltd.), as a reaction catalyst. The mixture is heated to 130° C. to perform a ring-opening reaction of the epoxy groups of the epoxy compound with the acid group of the rosin. The reaction is continued at the same temperature for four hours and is terminated when the acid value is 0.5 mg KOH/g to obtain hydrogenated bisphenol A rosin (HBPA-R) as particular rosin diol 1.

Particular Rosin Diol 2: Bisphenol A Rosin

In a stainless steel reaction container equipped with a stirrer, a heater, a condenser, and a thermometer are charged 104 parts by mass of bisphenol A diglycidyl ether (jER828 from Mitsubishi Chemical Corporation), as a difunctional epoxy compound, 200 parts by mass of disproportionated rosin (PINECRYSTAL KR-614 from Arakawa Chemical Industries, Ltd.), as a rosin component, and 0.4 part by mass of tetraethylammonium bromide (from Tokyo Chemical Industry Co., Ltd.), as a reaction catalyst. The mixture is heated to 130° C. to perform a ring-opening reaction of the epoxy groups of the epoxy compound with the acid group of the rosin. The reaction is continued at the same temperature for four hours and is terminated when the acid value is 0.5 mg KOH/g to obtain bisphenol A rosin as particular rosin diol 2.

Particular Rosin Diol 3: Propanediol Rosin

In a stainless steel reaction container equipped with a stirrer, a heater, a condenser, and a thermometer are charged 64 parts by mass of propanediol diglycidyl ether (EX-941 from Nagase ChemteX Corporation), as a difunctional epoxy compound, 200 parts by mass of a purified rosin prepared by distillation of gum rosin, as a rosin component, and 0.4 part by mass of tetraethylammonium bromide (from Tokyo Chemical Industry Co., Ltd.), as a reaction catalyst. The mixture is heated to 130° C. to perform a ring-opening reaction of the epoxy groups of the epoxy compound with the acid group of the rosin. The reaction is continued at the same temperature for four hours and is terminated when the acid value is 0.5 mg KOH/g to obtain propanediol rosin (PD-R) as particular rosin diol 3.

Synthesis of Polycondensate

Particular Rosin-Based Polycondensate 1

| | |
|---|---|
| Particular rosin diol 1 | 334 parts by mass |
| Propanediol | 11 parts by mass |
| Terephthalic acid | 50 parts by mass |
| Sebacic acid | 40 parts by mass |

The above components and 0.3 part by mass of tetra-n-butyl titanate (from Tokyo Chemical Industry Co., Ltd.), used as a reaction catalyst, are charged in a stainless steel reaction container equipped with a stirrer, a heater, a thermometer, a fractionating unit, and a nitrogen gas supply tube. A polycondensation reaction is performed at 230° C. in a nitrogen atmosphere with stirring for seven hours and is terminated when a predetermined molecular weight and acid value are reached to obtain particular rosin-based polycondensate 1.

Particular Rosin-Based Polycondensate 2

Particular rosin-based polycondensate 2 is prepared in the same manner as particular rosin-based polycondensate 1 except that the types and amounts of alcohol and carboxylic acid components are as follows:

| | |
|---|---|
| Particular rosin diol 2 | 237 parts by mass |
| Ethylene oxide adduct of Bisphenol A | 79 parts by mass |
| Isophthalic acid | 66 parts by mass |
| Dodecenylsuccinic anhydride | 26 parts by mass |

Particular Rosin-Based Polycondensate 3

Particular rosin-based polycondensate 3 is prepared in the same manner as particular rosin-based polycondensate 1 except that the types and amounts of alcohol and carboxylic acid components are as follows:

| | |
|---|---|
| Particular rosin diol 3 | 398 parts by mass |
| Terephthalic acid | 75 parts by mass |
| Dodecenylsuccinic anhydride | 13 parts by mass |

Comparative Rosin-Based Polycondensate 1

Synthesis of Acrylic-Acid-Modified Rosin

In a 10 L flask equipped with a fractionating column, a reflux condenser, and a receiver are placed 608 parts by mass of purified rosin (SP value: 71.3° C.) and 908 parts by mass of acrylic acid. The mixture is heated from 160° C. to 220° C. over eight hours, is reacted at 220° C. for two hours, and is distilled at 220° C. under 5.3 kPa to obtain an acrylic-acid-modified rosin.

In a heat-dried two-neck flask are placed 121 parts by mass of the acrylic-acid-modified rosin, 116 parts by mass of terephthalic acid, 53 parts by mass of 1,2-propanediol, 91 parts by mass of ethylene oxide adduct of bisphenol A, and dibutyltin oxide in an amount of 0.75 part by mass based on the amount of acid component (acrylic-acid-modified rosin and terephthalic acid). An inert gas atmosphere is maintained in the flask by introducing nitrogen gas, and the mixture is heated. A copolycondensation reaction is performed at 150° C. to 230° C. for 12 to 20 hours. The pressure is then gradually reduced at 210° C. to 250° C. to obtain comparative rosin-based polycondensate 1.

Preparation of Isocyanate-Containing Polymer

Isocyanate-Containing Polymer 1

In a reaction container equipped with a stirrer and a thermometer are charged 1,000 parts by mass of particular rosin-based polycondensate 1, which has a hydroxyl value of 58 mg KOH/g. The polycondensate is dehydrated by heating at 110° C. under 3 mmHg for one hour. To the dehydrated product are added 220 parts by mass of isophorone diisocyanate (IPDI). The mixture is reacted at 110° C. for 10 hours to obtain isocyanate-containing polymer 1, which has isocyanate groups at the ends thereof.

Isocyanate-Containing Polymer 2

In a reaction container equipped with a stirrer and a thermometer are charged 1,000 parts by mass of particular rosin-based polycondensate 2, which has a hydroxyl value of 58 mg KOH/g. The polycondensate is dehydrated by heating at 110° C. under 3 mmHg for one hour. To the dehydrated product are added 220 parts by mass of isophorone diisocyanate (IPDI). The mixture is reacted at 110° C. for 10 hours to obtain isocyanate-containing polymer 2, which has isocyanate groups at the ends thereof.

Isocyanate-Containing Polymer 3

A particular polycondensate (polycondensate having no rosin backbone) is synthesized as follows.

| | |
|---|---|
| Ethylene oxide adduct of bisphenol A | 64 parts by mass |
| Isophthalic acid | 17 parts by mass |
| Dodecenylsuccinic anhydride | 26 parts by mass |

The above components and 0.3 part by mass of tetra-n-butyl titanate (from Tokyo Chemical Industry Co., Ltd.), used as a reaction catalyst, are charged in a stainless steel reaction container equipped with a stirrer, a heater, a thermometer, a fractionating unit, and a nitrogen gas supply tube. A polycondensation reaction is performed at 230° C. in a nitrogen atmosphere with stirring for seven hours and is terminated when a predetermined molecular weight and acid value are reached to obtain a particular polycondensate.

In a reaction container equipped with a stirrer and a thermometer are charged 1,000 parts by mass of the resulting particular polycondensate. The polycondensate is dehydrated by heating at 110° C. under 3 mmHg for one hour. To the dehydrated product are added 220 parts by mass of isophorone diisocyanate (IPDI). The mixture is reacted at 110° C. for 10 hours to obtain isocyanate-containing polymer 3, which has isocyanate groups at the ends thereof.

Isocyanate-Containing Polymer 4

In a reaction container equipped with a stirrer and a thermometer are charged 1,000 parts by mass of comparative rosin-based polycondensate 1, which has a hydroxyl value of 58 mg KOH/g. The polycondensate is dehydrated by heating at 110° C. under 3 mmHg for one hour. To the dehydrated product are added 220 parts by mass of isophorone diisocyanate (IPDI). The mixture is reacted at 110° C. for 10 hours to obtain isocyanate-containing polymer 4, which has isocyanate groups at the ends thereof.

Example 1

Preparation of Toner Particles

Suspension 1

| | |
|---|---|
| Particular rosin-based polycondensate 1 | 240 parts by mass |
| Isocyanate-containing polymer 1 | 20 parts by mass |
| Carnauba wax (release agent) | 5 parts by mass |
| Copper phthalocyanine | 4 parts by mass |
| Ethyl acetate | 40 parts by mass |

The above components are placed in a beaker to prepare an ethyl acetate solution. The solution is stirred using a T.K. HOMO MIXER (From Primix Corporation) at 50° C. and 12,000 rpm to obtain suspension 1.

A mixture of 500 parts by mass of ion exchange water, 200 g of a 10% hydroxyapatite suspension, and 0.2 part by mass of sodium dodecylbenzenesulfonate is heated to 50° C. and is stirred using a T.K. HOMO MIXER (From Primix Corporation) at 12,000 rpm for 10 minutes while adding 300 parts by mass of suspension 1.

After stirring, the solution is transferred to a flask equipped with a stirrer and a thermometer, is heated to remove ethyl acetate, and is reacted by heating to 98° C. for five hours to obtain toner particle dispersion 1.

Toner particle dispersion 1 is then centrifuged to remove the supernatant. After 100 parts by mass of water are added, the dispersion is centrifuged again. This process is repeated twice. The resulting particles are dried to obtain toner particles 1.

Preparation of Toner

Using a Henschel mixer, 100 parts by mass of toner particles 1, 0.7 part by mass of hydrophobic silica, and 0.3 part by mass of hydrophobic titanium oxide are mixed together to obtain toner 1.

Preparation of Developer

In a pressure kneader are placed 100 parts of ferrite particles (from Powdertech, weight average particle size=50 μm), 1.5 parts by mass of a methyl methacrylate resin (from Mitsubishi Rayon Co., Ltd., weight average molecular weight=95,000), and 500 parts by mass of toluene. The mixture is stirred at room temperature (25° C.) for 15 minutes, is heated to 70° C. under reduced pressure with stirring to remove toluene, and is cooled and sized through a 105 μm mesh to obtain a resin-coated ferrite carrier.

The resulting resin-coated ferrite carrier and toner 1 are mixed together to prepare a developer (two-component electrostatic image developer) having a toner concentration of 7% by mass.

Evaluations

Example 1 is evaluated as follows.

The results are shown in Table 1.

Measurement of Toner Fixability after Tape Removal

The print density of a fixed image formed on plain paper using toner 1 is measured as optical density (status A density). An adhesive tape (Scotch® mending tape from Sumitomo 3M Limited) is lightly laminated on the fixed image on the plain paper. An iron cylindrical block having a diameter of 100 mm and a thickness of 20 mm is rolled over the tape in close contact therewith. After the tape is removed, the print density (optical density) of the image formed on the plain paper is measured again. The toner fixability (%) is calculated as the percentage of the optical density after tape removal to the optical density before tape removal. The optical density is measured using a Macbeth PCM meter (from Macbeth).

The toner fixability (%) is evaluated as follows.

The strength of the fixed image against tape removal is rated according to the toner fixability (%) on the following scale:

Good: 95% or more

Fair: 70% to less than 95%

Poor: less than 70%

Thermal Storage Stability

The resulting developers are used with a DocuCentre Color 400 (from Fuji Xerox Co., Ltd.) to print 10,000 images with an area coverage of 1% on color print paper (J-paper from Fuji Xerox Co., Ltd.) at 28° C. and 85% RH. The fixing temperature is set to 30° C. higher than the lowest possible fixing temperature. After 10,000 images are printed, the solid area of the last image is visually inspected for white streaks, and the toner is removed from the developing device and is visually inspected for toner adhesion (blocking). Based on the results of the inspection, the thermal storage stability is evaluated as follows.

The thermal storage stability is rated on the following scale:

Excellent: no white streaks and little or no toner adhesion in the developing device Good: no white streaks and slight toner adhesion in the developer Fair: a few white streaks and some toner adhesion in the developing device Poor: clear white streaks and toner adhesion in the developing device

Example 2

Toner particles 2 are prepared as in Example 1 except that 240 parts by mass of particular rosin-based polycondensate 1 are replaced by 150 parts by mass of particular rosin-based polycondensate 2 and 20 parts by mass of isocyanate-containing polymer 1 are replaced by 90 parts by mass of isocyanate-containing polymer 2.

As in Example 1, toner 2 is prepared using toner particles 2, and a developer is prepared using toner 2.

The resulting developer is evaluated as in Example 1. The results are shown in Table 1.

Example 3

A double-screw kneader is charged with 240 parts by mass of particular rosin-based polycondensate 3 at 10 kg/h. The polycondensate is transported while being melted and kneaded. The kneader is also charged with 4 parts by mass of isophorone diisocyanate at 600 kg/h. The mixture is reacted with continued kneading and is then extruded and cooled to obtain toner particles 3.

As in Example 1, toner 3 is prepared using toner particles 3, and a developer is prepared using toner 3.

The resulting developer is evaluated as in Example 1. The results are shown in Table 1.

Example 4

Toner particles 4 are prepared as in Example 1 except that 20 parts by mass of isocyanate-containing polymer 1 are replaced by 20 parts by mass of isocyanate-containing polymer 3.

As in Example 1, toner 4 is prepared using toner particles 4, and a developer is prepared using toner 4.

The resulting developer is evaluated as in Example 1. The results are shown in Table 1.

Comparative Example 1

Preparation of Toner Particles

Comparative Suspension 1

| | |
|---|---|
| Particular rosin-based polycondensate 1 | 240 parts by mass |
| Carnauba wax | 5 parts by mass |
| Copper phthalocyanine | 4 parts by mass |
| Ethyl acetate | 40 parts by mass |

The above components are placed in a beaker to prepare an ethyl acetate solution. The solution is stirred using a T.K. HOMO MIXER (From Primix Corporation) at 50° C. and 12,000 rpm to obtain comparative suspension 1.

A mixture of 500 parts by mass of ion exchange water, 200 g of a 10% hydroxyapatite suspension, and 0.2 part by mass of sodium dodecylbenzenesulfonate is heated to 50° C. and is stirred using a T.K. HOMO MIXER (From Primix Corporation) at 12,000 rpm for 10 minutes while adding 300 parts by mass of comparative suspension 1.

After stirring, the solution is transferred to a flask equipped with a stirrer and a thermometer, is heated to remove ethyl acetate, and is reacted by heating to 98° C. for five hours to obtain comparative toner particle dispersion 1.

Comparative toner particle dispersion 1 is then centrifuged to remove the supernatant. After 100 parts by mass of water are added, the dispersion is centrifuged again. This process is repeated twice. The resulting particles are dried to obtain comparative toner particles 1.

As in Example 1, comparative toner 1 is prepared using comparative toner particles 1, and a developer is prepared using comparative toner 1.

The resulting developer is evaluated as in Example 1. The results are shown in Table 1.

Comparative Example 2

Comparative toner particles 2 are prepared according to Table 1 in the same manner as in Example 3 except that isophorone diisocyanate is not used.

As in Example 1, comparative toner 2 is prepared using comparative toner particles 2, and a developer is prepared using comparative toner 2.

The resulting developer is evaluated as in Example 1. The results are shown in Table 1.

Comparative Example 3

Comparative toner particles 3 are prepared as in Example 1 except that 240 parts by mass of particular rosin-based polycondensate 1 are replaced by 240 parts by mass of comparative rosin-based polycondensate 1 and 20 parts by mass of isocyanate-containing polymer 1 are replaced by 20 parts by mass of isocyanate-containing polymer 4.

As in Example 1, comparative toner 3 is prepared using comparative toner particles 3, and a developer is prepared using comparative toner 3.

The resulting developer is evaluated as in Example 1. The results are shown in Table 1.

TABLE 1

| | | Example 1 | Example 2 | Example 3 | Example 4 |
|---|---|---|---|---|---|
| Composition of toner particles | Particular rosin-based polycondensate (parts by mass) | Particular rosin-based polycondensate 1 (240 parts by mass) | Particular rosin-based polycondensate 2 (150 parts by mass) | Particular rosin-based polycondensate 3 (240 parts by mass) | Particular rosin-based polycondensate 1 (240 parts by mass) |
| | Comparative rosin-based polycondensate (parts by mass) | — | — | — | |
| | Isocyanate-containing compound (parts by mass) | Isocyanate-containing polymer 1 (20 parts by mass) | Isocyanate-containing polymer 2 (90 parts by mass) | Isophorone diisocyanate (4 parts by mass) | Isocyanate-containing polymer 3 (20 parts by mass) |
| Method for manufacturing toner particles | | Solution suspension | Solution suspension | Pulverization | Solution suspension |
| Evaluations | Toner fixability | Good | Good | Fair | Good |
| | Thermal storage stability | Excellent | Excellent | Good | Good |

| | | Comparative Example 1 | Comparative Example 2 | Comparative Example 3 |
|---|---|---|---|---|
| Composition of toner particles | Particular rosin-based polycondensate (parts by mass) | Particular rosin-based polycondensate 1 (240 parts by mass) | Particular rosin-based polycondensate 3 (240 parts by mass) | — |
| | Comparative rosin-based polycondensate (parts by mass) | — | — | Comparative rosin-based polycondensate (240 parts by mass) |
| | Isocyanate-containing compound (parts by mass) | — | — | Isocyanate-containing polymer 4 (20 parts by mass) |
| Method for manufacturing toner particles | | Solution suspension | Pulverization | Solution suspension |
| Evaluations | Toner fixability | Poor | Poor | Poor |
| | Thermal storage stability | Fair | Fair | Poor |

The above results demonstrate that the fixed images formed using the toners of the Examples had a higher toner fixability and thermal storage stability than those of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

a polyester resin formed by a polycondensate of a carboxylic acid component and an alcohol component including a rosin diol represented by general formula (1), and an isocyanate-containing compound:

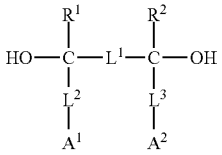

(1)

wherein $R^1$ and $R^2$ are each independently hydrogen or methyl;

$L^1$, $L^2$, and $L^3$ are each independently a divalent linking group selected from the group consisting of carbonyl, carboxyl, ether, sulfonyl, optionally substituted linear alkylenes, optionally substituted cyclic alkylenes, optionally substituted arylenes, and combinations thereof; and $A^1$ and $A^2$ are rosin ester groups.

2. The electrostatic-image developing toner according to claim 1, wherein the rosin diol is synthesized from a rosin and a difunctional epoxy compound.

3. The electrostatic-image developing toner according to claim 2, wherein the rosin is disproportionated.

4. The electrostatic-image developing toner according to claim 2, wherein the rosin is hydrogenated.

5. The electrostatic-image developing toner according to claim 1, wherein the carboxylic acid component includes an aromatic carboxylic acid.

6. The electrostatic-image developing toner according to claim 1, wherein the isocyanate-containing compound is an isocyanate-containing polyester.

7. The electrostatic-image developing toner according to claim 1, wherein the polyester resin has ester bonds and urethane bonds, the ratio of the urethane bonds to the ester bonds being about 3:1 to 1:10.

8. The electrostatic-image developing toner according to claim 7, wherein the ratio of the urethane bonds to the ester bonds is about 1:1 to 1:5.

9. The electrostatic-image developing toner according to claim 1, wherein the toner is manufactured by:

dissolving at least the polyester resin in an organic solvent to prepare an organic solvent solution;

suspending the organic solvent solution in an aqueous solvent to prepare a suspension; and removing the organic solvent from the suspension.

10. An electrostatic image developer comprising the electrostatic-image developing toner according to claim 1.

11. A toner cartridge attachable to and detachable from an image-forming apparatus, the toner cartridge containing the electrostatic-image developing toner according to claim 1.

12. A process cartridge attachable to and detachable from an image-forming apparatus, the process cartridge comprising a developing unit that contains the electrostatic image developer according to claim 10 and that develops an electrostatic image formed on an image carrier with the electrostatic image developer to form a toner image.

13. A method for forming an image, comprising:

charging an image carrier;

forming an electrostatic image on the charged image carrier;

developing the electrostatic image formed on the image carrier with the electrostatic image developer according to claim 10 to form a toner image;

transferring the toner image from the image carrier to a transfer medium; and fixing the toner image to the transfer medium.

* * * * *